US007165888B2

(12) United States Patent
Rodick

(10) Patent No.: US 7,165,888 B2
(45) Date of Patent: Jan. 23, 2007

(54) RESEALABLE CLOSURES FOR PACKAGES AND PACKAGES CONTAINING THE SAME

(75) Inventor: Ronald G. Rodick, Mentor, OH (US)

(73) Assignee: Avery Dennison Corporation, Pasadena, CA (US)

( * ) Notice: Subject to any disclaimer, the term of this patent is extended or adjusted under 35 U.S.C. 154(b) by 777 days.

(21) Appl. No.: 09/915,624

(22) Filed: Jul. 25, 2001

(65) Prior Publication Data

US 2003/0039412 A1 Feb. 27, 2003

(51) Int. Cl.
*B65D 33/00* (2006.01)
*B65D 33/18* (2006.01)

(52) U.S. Cl. ..... 383/211; 383/86

(58) Field of Classification Search ..... 383/211, 383/95, 86, 203
See application file for complete search history.

(56) References Cited

U.S. PATENT DOCUMENTS

| | | | | |
|---|---|---|---|---|
| 3,113,986 A | | 12/1963 | Breslow et al. | 260/683.9 |
| 3,154,239 A | | 10/1964 | Madsen | 229/62 |
| 3,251,905 A | | 5/1966 | Zelinski | 260/879 |
| 3,390,207 A | | 6/1968 | Moss et al. | 260/879 |
| 3,598,887 A | | 8/1971 | Darcy et al. | 260/879 |
| 3,620,988 A | | 11/1971 | Cohen | 260/17.4 |
| 3,639,521 A | | 2/1972 | Hsieh | 260/880 |
| 3,648,923 A | * | 3/1972 | Young | 229/67.3 |
| 3,691,140 A | | 9/1972 | Silver | 260/78.5 |
| 3,827,625 A | | 8/1974 | Miller | 229/62 |
| 3,912,581 A | | 10/1975 | Fink et al. | 162/164 |
| 3,993,815 A | * | 11/1976 | Douek et al. | 428/40.2 |
| 4,166,152 A | | 8/1979 | Baker et al. | 428/522 |
| 4,208,356 A | | 6/1980 | Fukawa et al. | 525/89 |
| 4,219,627 A | | 8/1980 | Halasa et al. | 525/89 |
| 4,226,952 A | | 10/1980 | Halasa et al. | 525/192 |
| 4,260,061 A | * | 4/1981 | Jacobs | 383/203 |
| 4,441,613 A | | 4/1984 | Hain et al. | 206/621 |
| 4,495,318 A | | 1/1985 | Howard | 524/375 |
| 4,500,021 A | * | 2/1985 | Bildusas | 225/49 |
| 4,512,479 A | | 4/1985 | Hain et al. | 206/632 |
| 4,543,139 A | | 9/1985 | Freedman et al. | 156/152 |
| 4,578,429 A | | 3/1986 | Gergen et al. | 525/291 |
| 4,584,217 A | | 4/1986 | McClintock | 428/40 |
| 4,598,112 A | | 7/1986 | Howard | 524/78 |
| 4,599,265 A | | 7/1986 | Esmay | 428/355 |

(Continued)

OTHER PUBLICATIONS

EDITORIAL, "Reclosable Pet Food Bag Label Is a Breed Apart," Packaging Digest, Jun. 2000, p. 68, New York.

(Continued)

*Primary Examiner*—Jes F. Pascua
(74) *Attorney, Agent, or Firm*—Renner, Otto, Boisselle & Sklar, LLP

(57) ABSTRACT

A resealable closure for a container is described which includes a container having a main body portion and an integral extended body portion foldable over a part of the main body portion; and a releasable enclosure comprising a release surface and a releasable adhesive having a peel strength up to about 1 pound per inch, in which (a) the release surface is adhered to the main body portion and the releasable adhesive is adhered to the extended body portion, or (b) the releasable adhesive is adhered to the main body portion and the release surface is adhered to the extended body portion.

33 Claims, 9 Drawing Sheets

U.S. PATENT DOCUMENTS

| | | | | | |
|---|---|---|---|---|---|
| 4,622,799 | A | | 11/1986 | Boston | 53/415 |
| 4,629,663 | A | | 12/1986 | Brown et al. | 428/343 |
| 4,645,711 | A | | 2/1987 | Winslow et al. | 428/355 |
| 4,657,970 | A | | 4/1987 | Shiraki et al. | 525/57 |
| 4,690,322 | A | * | 9/1987 | Burns | 229/80 |
| 4,786,696 | A | | 11/1988 | Bohnel | 526/88 |
| 4,795,782 | A | | 1/1989 | Lutz et al. | 525/66 |
| 4,833,179 | A | | 5/1989 | Young et al. | 522/183 |
| 4,840,270 | A | * | 6/1989 | Caputo et al. | 206/205 |
| 4,871,265 | A | * | 10/1989 | Peck | 383/89 |
| 4,911,563 | A | | 3/1990 | Ciani | 383/89 |
| 4,915,289 | A | * | 4/1990 | Hatano et al. | 229/123.1 |
| 5,035,518 | A | | 7/1991 | McClintock | 383/70 |
| 5,141,793 | A | | 8/1992 | Fontanilla | 428/42 |
| 5,180,635 | A | | 1/1993 | Plamthottam et al. | 428/345 |
| 5,192,612 | A | * | 3/1993 | Otter et al. | 428/355 RA |
| 5,427,849 | A | | 6/1995 | McClintock et al. | 428/353 |
| 5,616,385 | A | | 4/1997 | Rothrum et al. | 428/40.1 |
| 5,656,705 | A | | 8/1997 | Mallya et al. | 526/233 |
| 5,824,380 | A | | 10/1998 | Hagen | 428/41.9 |
| 5,855,434 | A | | 1/1999 | Hagen | 383/89 |
| 5,888,335 | A | * | 3/1999 | Kobe et al. | 156/306.3 |
| 5,948,400 | A | * | 9/1999 | Brett | 424/78.03 |
| 6,048,100 | A | | 4/2000 | Thrall et al. | 383/86 |
| 6,110,586 | A | * | 8/2000 | Johnson | 428/352 |
| 6,120,184 | A | | 9/2000 | Laurence et al. | 383/205 |
| 6,241,390 | B1 | * | 6/2001 | Schneck | 383/203 |
| 6,299,355 | B1 | * | 10/2001 | Schneck | 383/205 |
| 6,315,448 | B1 | * | 11/2001 | Thrall | 383/205 |
| 6,325,541 | B1 | * | 12/2001 | Thrall et al. | 383/203 |
| 6,328,472 | B1 | * | 12/2001 | Laurence et al. | 383/211 |
| 6,478,465 | B1 | * | 11/2002 | Thrall | 383/205 |
| 2002/0023924 | A1 | * | 2/2002 | Wisniewski et al. | 220/359.1 |

OTHER PUBLICATIONS

PCT/US02/23499; PCT International Search Report mailed Dec. 19, 2002.

* cited by examiner

Fig. 3-Inv

Fig. 4-Inv

Fig. 5-Inv

RESEALABLE CLOSURES FOR PACKAGES AND PACKAGES CONTAINING THE SAME

FIELD OF THE INVENTION

The present invention relates to resealable packages and more particularly to resealable closures for containers and packages, such as bags, flexible packages, semi-rigid and rigid containers.

BACKGROUND OF THE INVENTION

Containers or bags formed of heavy weight, multiple ply paper are conventionally employed for containing, storing and shipping flowable, fine powdery materials and small sized granular products, such as starch, human and animal food products, chemicals, cement and the like. A continuing problem has been providing reclosing and/or resealing means for use when a portion of the contents of the container remains after partial removal.

Various procedures and products have been suggested in the prior art for overcoming the problems of reclosing containers. A variety of recloseable and resealable containers for such uses are available in the art. Packagers and suppliers of adhesive products to packagers, have sought in various ways to provide resealable closures for such packages which are reliable, and easy and convenient to use.

U.S. Pat. No. 3,154,239 (Madsen) discloses a resealable bag in which the sealing device is a paper flap foldable over an open end of the bag. One side of the flap is secured to the bag with a permanent adhesive, while the other side of the flap is releasably attached to the bag by a pressure sensitive adhesive.

U.S. Pat. No. 4,441,613 (Hain et al), discloses a resealable bag for containing a flowable product which includes a plurality of panels hingedly coupled along fold lines, an opening at one end of the bag, a flap hingedly coupled to one panel along a fold line for overlapping an opposite panel and closing the opening, and a strip of adhesive tape for opening and resealing the flap. An adhesive layer extends across the entire width of the flap to seal the flap to the opposite panel. The adhesive layer seal can have a reduced bonding strength adjacent one end of the flap to facilitate opening of the flap at the reduced bond strength section. The reduced bonding strength is provided by an abhesive coating comprising kaolin clay.

U.S. Pat. No. 4,543,139 (Freedman et al), for example, addresses the problem of loss of adhesion through repeated use or due to contamination by employing adjoining strata of pressure-sensitive adhesive. The two adhesive strata have different adhesion to the substrate. The adhesive strata are used as a recloseable fastener and are intermixed in the course of reclosing and reopening the package. The reopening action compensates for contamination of the adhesive occurring at the reseal interface.

U.S. Pat. No. 4,911,563 (Ciani) discloses a re-closeable package having a bifurcated adhesive member secured to the body portion of the package at a distance from the opening thereof. The member has a jaw-like construction with a hinge line about which one of the jaws pivots. In use, the jaws are opened by the user, the re-closed, folded end of the package is inserted into the jaws, and the jaws subsequently closed to retain the package in re-closed condition.

U.S. Pat. No. 5,035,518 (McClintock) describes a hinge type pressure sensitive resealable closure system for a container, including a separate flat strip of material permanently adhered at one surface to the container. Another surface of the strip includes a removable pressure sensitive adhesive, to be removably attached to the container.

U.S. Pat. Nos. 5,824,380 and 5,855,434 (Hagen) both disclose a package reclosure label strip which is secured by a pressure-sensitive adhesive to the package. In U.S. Pat. No. 5,824,380, a Z-folded top sheet has a first panel permanently adhered to the upper surface of the base sheet, a second panel folded back over the first panel with an edge extending past the first panel that is releasably adhered to the base sheet, and a third panel folded back over the second panel and extending beyond the second panel to an opening tab which is resealably adhered to the package. The label can be opened or extended by lifting the opening tab off the package and breaking the releasable bond between the second panel and the base sheet. In U.S. Pat. No. 5,855,434, the top sheet is not Z-folded, but operates substantially similarly to the strip disclosed in U.S. Pat. No. 5,824,380.

U.S. Pat. No. 6,048,100 (Thrall et al) discloses a resealable closure for a bag. The upper ends of bag wall members are folded downwardly adjacent the front wall member to form a flap which extends across the upper end of the bag with the upper flap being permanently sealed by an adhesive to the front wall member except for a flap portion adjacent one of the side wall members. The resealable closure is positioned between the flap portion and the front wall of the bag and permits the flap portion to be opened to form a pour opening in the upper corner of the bag. The flap portion may be resealed by the resealable closure. The containers described in U.S. Pat. No. 6,048,100 include a strong adhesive which results in difficult and noisy re-opening.

The foregoing containers and materials have achieved a certain level of acceptance. However, difficulties still exist. The adhesives become contaminated by the container contents. Adhesion strength is lost upon repeated use. Obtrusive devices are attached to the outside of the container. Difficult-to-use closure means are employed, such as reclosure strips, which must be either freed or reattached for use after opening the container. Another continuing problem is the noise associated with re-opening the adhesively closed reclosure device. The noise is often loud and annoying, and may have a sound like woven fabric being violently torn. Consumers and users of the containers remain unsatisfied because of aesthetically undesirable effects, such as noisy opening.

Despite improvements in resealable containers, a need remains for a resealable closure which is releasable, and which provides both a strong, secure closure, and easy re-opening without undue noise.

SUMMARY OF THE INVENTION

A resealable closure for a container is described which includes a container having a main body portion and an integral extended body portion foldable over a part of the main body portion; and a releasable enclosure comprising a release surface and a releasable adhesive having a peel strength up to about 1 pound per inch, in which (a) the release surface is adhered to the main body portion and the releasable adhesive is adhered to the extended body portion, or (b) the releasable adhesive is adhered to the main body portion and the release surface is adhered to the extended body portion.

In one embodiment, the present invention includes a resealable closure for a container, the container having a first body portion and a second body portion, the resealable closure including a release surface; and a releasable adhesive having a peel strength up to about 1 pound per inch, in which a first side of the release surface is attached to one of the first body portion or the second body portion by a second adhesive, a second side of the release surface is releasably attached to a first side of the releasable adhesive, a second side of the releasable adhesive is attached to a substrate which comprises another of the second body portion or the first body portion, and the first body portion is a main body portion and the second body portion is an extended body portion foldable over a part of the main body portion.

The resealable container of the present invention thus provides the features of a secure but easily releasable closure, which when re-opened easily releases with little or no noise, and when re-closed reseals securely and reliably.

BRIEF DESCRIPTION OF THE DRAWINGS

FIGS. 3-I*nv*, 4-Inv and 5-Inv are cross-sectional views corresponding to FIGS. 3, 4 and 5 in which the layers of the resealable closure are inverted.

DETAILED DESCRIPTION OF THE INVENTION

Figure 1:
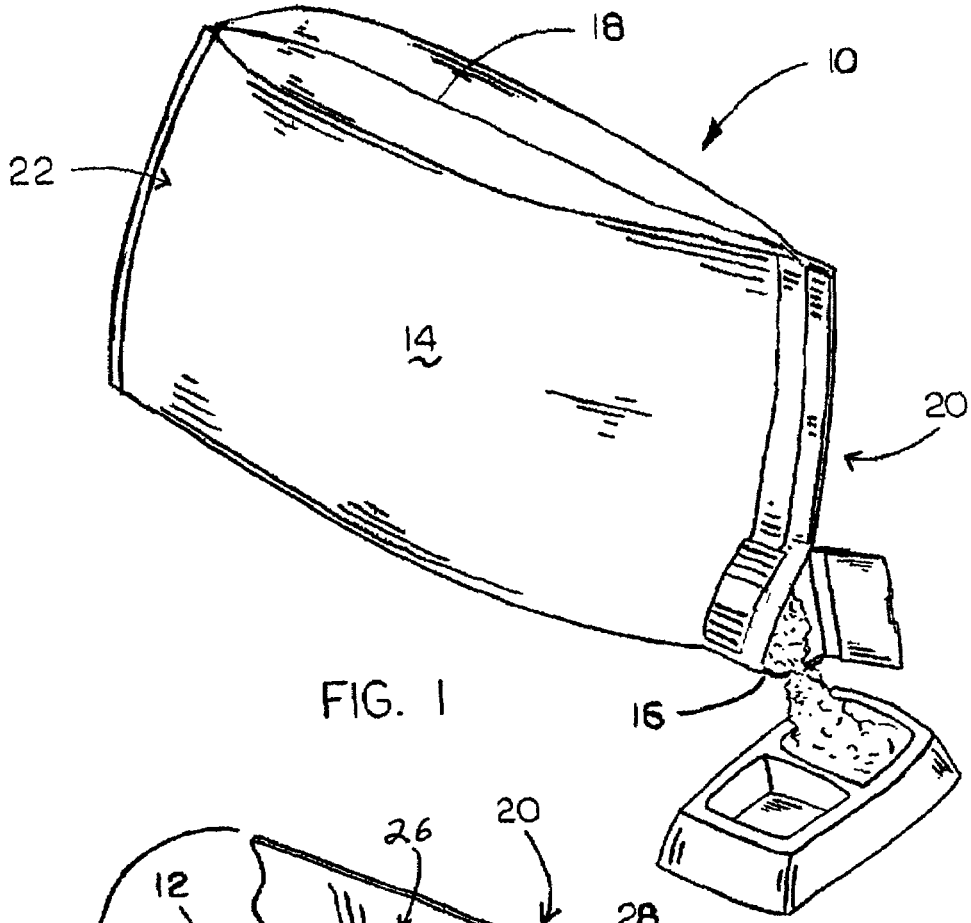
FIG. 1 illustrates in perspective a bag which includes one embodiment of a resealable closure in accordance with the present invention.

The resealable closures of the present invention exhibit a secure reclosure of the container. The reclosures also open easily and quietly, producing little or no objectionable sound. Accordingly, the resealable closures are useful in a variety of applications where resealability is needed.

The present invention is directed to a resealable closure for a container which, in one embodiment, includes a container having a main body portion and an integral extended body portion foldable over a part of the main body portion; and a releasable enclosure comprising a release surface and a releasable adhesive having a peel strength up to about 1 pound per inch, in which (a) the release surface is adhered to the main body portion and the releasable adhesive is adhered to the extended body portion, or (b) the releasable adhesive is adhered to the main body portion and the release surface is adhered to the extended body portion.

Resealable Closure

The resealable closure comprises a release surface and a releasable adhesive having a peel strength up to about 1, or up about to 0.8, or up to about 0.5 pound per inch. In one embodiment, the releasable adhesive has a peel strength in the range from about 0.4 to about 1 pound per inch, or from about 0.5 to about 0.9 pound per inch, or from about 0.6 to about 0.8 pound per inch. The peel strengths used herein refer to 90° peel strengths, tested according to PSTC-1 as described in ASTM D1000-99. This method measures the peeling force necessary to remove a pressure sensitive adhesive from a standard stainless steel panel to which it has been applied, under specified conditions. Here, and elsewhere in the specification and claims, the range and ratio limits may be combined.

In one embodiment, there is little or no noise created when separating the releasable adhesive and the release surface.

Release Surface

The release surface may be a substrate, such as a polymer film or paper with a releasable coating. The release surface may be any suitable material that imparts a lower surface energy to the release surface, and has properties with respect to the releasable adhesive so it will release therefrom with a peel strength of up to about 1 pound. Typical release coatings are listed in chapters 17 and 18 of the Handbook of Pressure-Sensitive Adhesive Technology by Donatas Satas, Van Nostrand Reinhold Company, 1983. The release surface, as described above, may be paper or polymer substrate with or without a releasable coating. Polymer films are often used without releasable coatings. The paper is typically used with the releasable coating which may include silicon coatings, or polymeric coatings such as those polymers described below. An example of a useful polymeric coating is a polyethylene coating.

The polymer film may be any polymer which provides a releasable surface. The polymers may be a monolayer or a multilayer polymer film. The polymers may be used with or without a releasable coating. In one embodiment, the polymer film is used free of a releasable coating. The polymer film may be non-oriented film, uniaxially oriented film or biaxially oriented film. When uniaxially oriented, the orientation may be either in the machine direction or in the cross direction. The polymer film materials useful as the release surface include polystyrenes, polyolefins, polyamides, polyesters, polycarbonates, polyvinyl alcohol, poly (ethylene vinyl alcohol), polyvinyl chloride, polyurethanes, polyacrylates including copolymers of olefins such as ethylene and propylene with acrylic acids and esters, copolymers of olefins and vinyl acetate, ionomers and mixtures thereof. In one embodiment, the polymer film material is a polyolefin.

The polyolefins, which can be utilized as the release surface, include polymers and copolymers of ethylene, propylene, 1-butene, etc., or blends of mixtures of such polymers and copolymers. The polyolefins may comprise polymers and copolymers of ethylene and propylene. In another embodiment, the polyolefins comprise propylene homopolymers, and copolymers such as propylene-ethylene and propylene-1-butene copolymers. Blends of polypropylene and polyethylene with each other, or blends of either or both of them with polypropylene-polyethylene copolymer also are useful. In another embodiment, the polyolefin film materials are those with a very high propylenic content, either polypropylene homopolymer or propylene-ethylene copolymers or blends of polypropylene and polyethylene with low ethylene content, or propylene-1-butene copolymers or blend of polypropylene and poly-1-butene with low butene content.

Various polyethylenes can be utilized as the release surface material including low, medium, and high density polyethylenes, and mixtures thereof. An example of a useful low density polyethylene (LDPE) is REXENE® 1017 available from Huntsman. An example of a useful high density polyethylene (HDPE) is Formoline LH5206 available from Formosa Plastics. In one embodiment, the polymer film material comprises a blend of about 80% to about 90% HDPE and about 10–20% of LDPE.

The propylene homopolymers which can be utilized as the release surface in the invention, either alone, or in combination with a propylene copolymer as described herein, include a variety of propylene homopolymers such as those having melt flow rates (MFR) from about 0.5 to about 20 as determined by ASTM Test D 1238. In one embodiment, propylene homopolymers having MFR's of less than about 10, or from about 4 to about 9 are particularly useful. Useful propylene homopolymers also may be characterized as having densities in the range of from about 0.88 to about 0.92 g/cm$^3$. A number of useful propylene homopolymers are available commercially from a variety of sources, and some useful polymers include: 5A97, available from Union Carbide and having a melt flow of 12.0 g/10 min and a density of 0.90 g/cm$^3$; DX5E66, also available from Union Carbide and having an MFI of 8.8 g/10 min and a density of 0.90 g/cm$^3$; and WRD5-1057 from Union Carbide having an MFI of 3.9 g/10 min and a density of 0.90 g/cm$^3$. Useful commercial propylene homopolymers are also available from Fina and Montel.

In one embodiment, the release surface is polypropylene. In one embodiment, the polypropylene is isotactic or syntactic. In one embodiment, the polypropylene is uniaxially oriented in the machine direction, or uniaxially oriented in the cross direction. In one embodiment, the polypropylene is oriented biaxially.

Examples of useful polyamide resins include resins available from EMS American Grilon Inc., Sumter, S.C., under the general tradename GRIVORY®, such as CF6S, CR-9, XE3303 and G-21. GRIVORY® G-21 is an amorphous nylon copolymer having a glass transition temperature of 125° C., a melt flow index (DIN 53735) of 90 ml/10 min and an elongation at break (ASTM D638) of 15. GRIVORY® CF65 is a nylon 6/12 film grade resin having a melting point of 135° C., a melt flow index of 50 ml/10 min, and an elongation at break in excess of 350%. GRIVORY® CR-9 is another nylon 6/12 film grade resin having a melting point of 200° C., a melt flow index of 200 ml/10 min, and an elongation at break at 250%. GRIVORY® XE 3303 is a nylon 6.6/6.10 film grade resin having a melting point of 200° C., a melt flow index of 60 ml/10 min, and an elongation at break of 100%. Other useful polyamide resins include those commercially available from, for example, Union Camp of Wayne, New Jersey under the UNI-REZ® product line, and dimer-based polyamide resins available from Bostik, Emery, Fuller, Henkel (under the VERSAMID® product line). Other suitable polyamides include those produced by condensing dimerized vegetable acids with hexamethylene diamine. Examples of polyamides available from Union Camp include UNI-REZ® 2665; UNI-REZ® 2620; UNI-REZ® 2623; and UNI-REZ® 2695. Some of the physical properties of polymer films formed from the UNI-RED® polyamides are summarized in the following Table I.

TABLE I

| UNI-RED ® Product | Softening Point (° C.) | Brookfield Viscosity (cPs at 190° C.) | Tensile Percent Strength (PSI) | Tensile Percent Ultimate Elongation |
|---|---|---|---|---|
| 2620 | 105 | 900 | 1000 | 50 |
| 2623 | 106 | 6500 | 1000 | 400 |
| 2665 | 165 | 11,000 | 2000 | 500 |
| 2695 | 128 | 5000 | 200 | 175 |
| 2620/2623 (blend at 1:3) | 128 | 5100 | 1000 | 313 |

Polystyrenes can also be utilized as the release surface material in the resealable closures and these include homopolymers as well as copolymers of styrene and substituted styrene such as alpha-methyl styrene. Examples of styrene copolymers and terpolymers include: acrylonitrile-butene-styrene (ABS); styrene-acrylonitrile copolymers (SAN); styrene butadiene (SB); styrene-maleic anhydride (SMA); and styrene-methyl methacrylate (SMMA); etc. An example of a useful styrene copolymer is KR-10 from Phillips Petroleum Co. KR-10 is believed to be a copolymer of styrene with 1,3-butadiene.

Polyurethanes also can be utilized as the release surface material in the resealable closures, and the polyurethanes may include aliphatic as well as aromatic polyurethanes.

Polyesters prepared from various glycols or polyols and one or more aliphatic or aromatic carboxylic acids also are useful film materials. Polyethylene terephthalate (PET), PETG (PET modified with cyclohexanedimethanol), and polybutyleneterephthalate (PBT) are useful film forming materials which are available from a variety of commercial sources, including Eastman. For example, KODAR® 6763 is a PETG available from Eastman Chemical. Another useful polyester from Du Pont is SELAR® PT-8307 which is polyethylene terephthalate.

Machine direction or biaxial orientation of the polymer films useful as the release surface can be accomplished by techniques known in the art. For example, the release surface material can be oriented in the machine direction by using tentering frames where the clips at the edge of the tentering frame travel faster in the machine direction thereby stretching the composite in the machine direction. Alternatively, the clips can be programmed to travel faster in the machine direction or to widen in the cross direction, or to stretch in both directions thereby orienting the composite in both directions. When the composite is to be stretched using a tenter frame, the edges of the film are preferably free of adhesive so that the clips will not stick to the film. After orientation on the tentering frame, the release materials then can be applied to a resealable closure for use with a bag or container as further described below.

Releasable Adhesive

The releasable adhesive may be an acrylate or methacrylate polymer, a rubber-based material, an ethylene-vinyl acetate copolymer, an ethylene vinyl alcohol copolymer, or others, such as silicones, etc. In one embodiment, the releasable adhesive may be a pressure sensitive adhesive.

In one embodiment, the releasable adhesive is an acrylic emulsion pressure-sensitive adhesive polymer. The acrylic emulsion pressure-sensitive adhesive polymers may contain on a percent by weight basis from 30% to about 98% percent by weight of one or more alkyl acrylates containing about 4 to about 12, or from about 4 to about 8 carbon atoms in the alkyl group. In one embodiment, the total alkyl acrylate concentration is from about 60 to about 95% by weight based on the total weight of the monomers. Useful monomers include alkyl acrylate esters containing from about 4 to about 10 carbon atoms in the alkyl group. Exemplary alkyl acrylate esters include isooctyl acrylate, 2-ethyl hexyl acrylate, butyl acrylate, sec-butyl acrylate, methyl butyl acrylate, 4-methyl 2-pentyl acrylate and the like. Comonomers which can be used include unsaturated mono and dicarboxylic acids such as methacrylic acid, acrylic acid, fumaric acid and the like, dibutyl fumarate, dioctyl maleate and the like. Other comonomers include methacrylates such as methyl methacrylate, isodecyl methacrylate and the like; styrene, vinyl acetate, vinyl pyrrolidone and the like.

The releasable adhesive may have a peel strength up to about 1, or up to about 0.8, or up to about 0.5 pound per inch. In one embodiment, the releasable adhesive has a peel strength in the range from about 0.4 to about 1 pound per inch, or from about 0.5 to about 0.9 pound per inch, or from about 0.6 to about 0.8 pound per inch.

In one embodiment, the releasable adhesive includes an acrylic pressure sensitive adhesive. In another embodiment, the releasable adhesive includes an acrylic emulsion pressure sensitive adhesive. In one embodiment, the releasable adhesive is an inherently tacky, infusible, elastomeric, pressure-sensitive adhesive microsphere polymer. In one embodiment, the releasable adhesives are referred to herein as "tacky microspheres". Adhesives comprising tacky microspheres have been referred to as "ultrareleasable adhesives" due to the relative ease with which they are separated from suitable release surfaces, "ease" being defined as including a quiet, smooth opening or release from adhering contact with the release surface, as well as adhering to the release surface with the disclosed peel strengths.

These adhesives may be prepared by one or more of the processes described in U.S. Pat. No. 3,620,988 to Cohen, (teaches the synthesis of suspension beads (microspheres) from acrylic monomers in the presence of a water insoluble suspension stabilizer such as crosslinked copolymer of acrylic acid.); U.S. Pat. No. 3,691,140 to Silver, (teaches the synthesis of infusible, tacky microspheres of alkyl acrylates in the presence of an ionic comonomer which is substantially oil insoluble and in the presence of an anionic emulsifier provided at a level above its critical micelle concentration (CMC).); U.S. Pat. No. 3,912,581 to Fink, (teaches the synthesis of suspension polymers of acrylic monomers in the presence of water soluble stabilizers or water-insoluble suspending agents, which are partially hydrolyzed polyvinyl acetate or sodium salt of a copolymer of methacrylic acid and one of its higher alkyl acrylate esters. Aluminum hydroxide is used as a water-insoluble suspending agent. An anionic emulsifier is also used to further improve suspension stability.); U.S. Pat. No. 4,166,152 to Baker, et al, (describes a method for making inherently tacky microspheres based on acrylic monomers in the presence of an ionic suspension stabilizer and an anionic emulsifier.); U.S. Pat. Nos. 4,495,318 and 4,598,112 to Howard, (teach a method of forming the tacky microspheres wherein nonionic or cationic emulsifiers are used in combination with an ionic suspension stabilizer, such as polyacrylic acid, which is neutralized to a pH of 7 with ammonia to convert it to ammonium salt.); U.S. Pat. No. 4,786,696 to Bohnel, (teaches a process for making tacky microspheres without the use of ionic comonomers taught by Silver or ionic suspension stabilizers taught by Baker et al or Howard.); U.S. Pat. No. 4,833,179 to Young et al, (teaches a process for making suspension polymer beads in the presence of suspending agents which are water-soluble inorganic salts such as tribasic calcium phosphate, barium sulfate, magnesium carbonate and the like, in addition a modifier moiety such as polystyrene macromer, reactive zinc salt or hydrophobic silica and the like.) or U.S. Pat. No. 5,656,705, issued to Mallya et al. These patents are incorporated herein by reference in their entirety for their teachings related to making such an adhesive. The process of Mallya et al is particularly useful.

An example of useful adhesives are available commercially form Fasson Roll Division of Avery Dennison under the tradenames Fasson® UR-1 and UR-2.

In one embodiment, tacky microspheres are prepared in an aqueous medium in which at least the principal or bulk of the monomers are substantially insoluble, in the presence of a suitable surfactant and a buffering agent provided in a quantity sufficient to maintain pH, both during and at the conclusion of the reaction, in the range of about 6 to about 9.5, and in one embodiment from about 7 to about 8.

In one embodiment, tacky microspheres are made from monomers which can be homopolymerized or copolymerized, and which are insoluble in aqueous media. In one embodiment, these monomers constitute the bulk of the monomers present for suspension polymerization. Useful monomers have been described above. The principal monomers should be substantially insoluble in the aqueous polymerization medium and be homopolymerizable or copolymerizable in suspension droplet form to form an infusible product which is an inherently tacky pressure-sensitive adhesive having a glass-transition temperature ($T_g$) of less than about −20° C. Tackifiers and plasticizers known to be compatible with the monomers can be dissolved in the monomers followed by polymerization of the monomers or may be added later. In addition, macromonomers or polymers could also be dissolved in the monomers.

In one embodiment, tacky microspheres are prepared from a reaction mixture in which the monomer is 2-ethyl hexyl acrylate, either alone or with a carboxylic acid. The content of carboxylic acid may be from 0 to about 5 percent by weight of the monomer(s). In one embodiment, the carboxylic acid is acrylic acid.

In one embodiment, tacky microspheres are prepared by a polymerization which occurs in the presence of a monomer soluble initiator such as benzoyl peroxide, chloromethyl benzoyl peroxide, lauroyl peroxide, decanoyl peroxide and the like. The concentration of the initiator may be from about 0.15 to about 0.5 percent by weight of the monomers, or from about 0.25 percent by weight of the monomers. In one embodiment, the initiator is benzoyl peroxide.

In one embodiment, tacky microspheres are prepared from an aqueous reaction medium which includes a surfactant in addition to the buffer. The surfactant optimizes stability of the reaction. The surfactant may be present in a concentration which may or may not be above its critical micelle concentration. A typical surfactant concentration is above about 1 gram per liter of water, or above 4 or more grams per liter, or above about 8 grams per liter of the water employed for suspension polymerization. In one embodiment, the surfactants are anionic surfactants, in another nonionic surfactants and in yet another, cationic surfactants.

Typical anionic surfactants are sulfosuccinates and alkyl aryl polyether sulfonates. Sulfosuccinates include sodium dioctyl sulfosuccinate (AEROSOL® OT, manufactured by American Cyanamid) and sodium dihexyl sulfosuccinate (AEROSOL® MA, manufactured by American Cyanamid), sodium alkyl aryl polyether sulfonates (TRITON® X-200, manufactured by Rohm and Haas) and sodium alkyl benzene sulfonate such as sodium dodecyl benzene sulfonate (RHODACAL® DS-10, manufactured by Rhone Poulenc). Nonionic surfactants include alkyl arylpolyether alcohols (TRITON® N-111, manufactured by Rohm & Haas) and the like. In one embodiment, the nonionic surfactant is used in combination with an anionic surfactant.

In one embodiment, tacky microspheres may include a degree of internal polymer cross-linking. Such cross-linking may provide cohesive strength and assist in achieving infusibility. One way to obtain the cross-linking is by hydrogen abstraction using a peroxide-initiator. Another way is to employ a multifunctional additive such as multifunctional acrylate, triallyl cyanurate and the like during polymerization to allow cross-linking reactions to occur to control gel content. As the gel content is increased, the modulus of the polymer increases as well. A low modulus is desired to obtain quick wetting and bond formation to surfaces on which a product is applied. An optimum balance between gel content and modulus is desired to provide good adhesive performance characteristics.

In one embodiment, the gel content of the tacky microspheres may be in the range from about 60 to about 80 percent by weight, or from about 65 to about 75 percent by weight, of the polymer. The gel content is determined by extraction with tetrahydrofuran (THF).

In one embodiment, the tacky microsphere adhesive, when tested with 50# uncoated paper at room temperature on standard lab panels, has a loop tack of about 0.4 lbs., or about 0.6 lbs., or about 0.1 to about 0.95 lbs., or about 0.2 to about 0.9 lbs., to stainless steel or glass, and a loop tack of about 0.2 lbs., or about 0.38 lbs., or about 0.1 to about 0.9 lbs., or about 0.1 to about 0.8 lbs., to HDPE. The loop tack may be higher when applied to treated HDPE.

In one embodiment, the tacky microsphere adhesive, when tested with 50# uncoated paper at room temperature on standard lab panels, has a 90° peel adhesion of about 0.29 lbs., or about 0.05 to about 0.95 lbs., or about 0.2 to about 0.9 lbs., to stainless steel or glass, and a 90° peel adhesion of about 0.38 lbs., or about 0.19 lbs., or about 0.1 to about 0.9 lbs., or about 0.1 to about 0.8 lbs., to HDPE. The 900 peel adhesion may be higher when applied to treated HDPE.

The coating weight of the releasable adhesive applied to the bag or container is generally in the range of about 0.1 to about 1000 gsm, and in one embodiment about 0.1 to about 500 gsm, and in one embodiment about 0.5 to about 250 gsm, and in one embodiment about 1 to about 100 gsm, and in one embodiment about 1 to about 50 gsm, and in one embodiment about 2 to about 28 gsm.

In one embodiment, the releasable adhesive includes non-adhesive microspheres. These microspheres may have an average diameter from about 10 microns to about 300 microns. The microspheres may be formed of glass, ceramic, phenolic or other non-tacky polymeric material. Suitable microspheres are disclosed in U.S. Pat. No. 5,180,635, the disclosure of which is incorporated herein by reference, for its teachings relating to microspheres and microbubbles.

The microspheres may be present in an amount of from about 5% to about 70% by volume of the releasable adhesive layer, and in one embodiment in an amount from about 10% to about 20% by volume of the releasable adhesive layer, or from about 5% to about 45% by volume, or from about 10% to about 30% by volume microspheres. The microspheres tend to reduce both the density and peel adhesion of the releasable adhesive layers. The microspheres may also improve conformability and strength properties, i.e. the combination of elongation and tensile strength of the layer.

The microspheres may be solid, hollow or porous and rigid or elastomeric. The microspheres may be made of any suitable material including glass, ceramic, polymeric and carbon materials.

Polymeric microspheres may be made of rigid materials or elastomeric materials. Suitable polymeric materials include thermosetting polymers, e.g., phenolic polymers, or thermoplastic polymers, e.g. polyvinylidene chloride acrylonitrile copolymers (PVDC copolymers).

As used herein, "microsphere" includes rigid microspheres having a density of less than about 1.0 g/cc and elastomeric microspheres having a density of less than about 1.5 g/cc. In one embodiment, the microspheres are hollow, and are generally available in a wide variety of densities and crush strengths. In one embodiment, the microspheres are ceramic hollow microspheres, which exhibit high crush strength and tend to be less expensive than glass, polymeric or hollow carbon microspheres.

The size, i.e., the average diameter, of the low density microspheres is preferably from about 10 to about 300 microns. Microspheres having a diameter less than about 10 microns may be suitable.

In one embodiment, the releasable adhesive comprises rigid, low density microspheres made of, for example, glass or ceramic having a density of from about 0.2 to about 1.0 g/cc, and the loading of microspheres is up to about 45% by volume. If microspheres having a density less than about 0.2 g/cc, e.g., hollow phenolic or elastomeric microspheres, are used, the loading may be as high as about 70% by volume.

Placement of the Resealable Closure

The resealable closure may be suitably located in an area of overlap defined by a folded-over flap and a main portion of a container overlain by the flap. Suitable containers are more fully described below, but all generally include the area of overlap as defined above. In one embodiment, (a) the release surface is adhered to the main body portion and the releasable adhesive is adhered to the extended body portion. In another embodiment, (b) the releasable adhesive is adhered to the main body portion and the release surface is adhered to the extended body portion.

The area upon which the releasable adhesive is adhered may be covered by a continuous or discontinuous film of the releasable adhesive. In an embodiment in which the releasable adhesive is adhered in a discontinuous film, the releasable adhesive may be in the form of strips or lines separated by strips or areas free of the releasable adhesive. The adhesive-free areas either contain no adhesive of any kind or contain a deadened area, i.e., an adhesive which includes areas upon which a non-adhesive material has been applied. For example, an area may be completely covered by an adhesive, but then selected areas, such as strips, of the adhesive may be covered by a non-adhesive material to form a deadened area. Non-adhesive materials include particulate materials such as mica, silica or talc, and detackifying materials such as detackifying resins or other materials which, when added to an adhesive, reduce or eliminate the adhesive properties thereof.

In one embodiment, the releasable adhesive is applied in a discontinuous film. In such embodiment, the releasable adhesive may be in the form of adhesive strips or islands separated by areas of no adhesive. In another embodiment in which the releasable adhesive is adhered in a discontinuous film, the releasable adhesive film includes strips or islands of adhesive-free areas separated by areas to which the adhesive has been applied.

The resealable closure of the present invention does not require a reclosure strip in addition to the resealable closure elements described herein. In one embodiment the resealable closure does not include such a reclosure strip.

Additives

The release surface material may contain inorganic fillers and other organic or inorganic additives to provide desired properties such as appearance properties (opaque or colored films), durability and processing characteristics. Nucleating agents can be added to increase crystallinity and thereby increase stiffness. Examples of useful materials include calcium carbonate, titanium dioxide, metal particles, fibers, flame retardants, antioxidant compounds, heat stabilizers, light stabilizers, ultraviolet light stabilizers, antiblocking agents, processing aids, acid acceptors, etc.

Various nucleating agents and pigments can be incorporated into the films of the present invention. The amount of nucleating agent added should be an amount sufficient to provide the desired modification of the crystal structure while not having an adverse effect on the desired properties of the films. It is generally desired to utilize a nucleating agent to modify the crystal structure and provide a large number of considerably smaller crystals or spherulites to improve the transparency (clarity), and stiffness, and the die-cuttability of the film. Obviously, the amount of nucleating agent added to the film formulation should not have a deleterious affect on the clarity of the film. Nucleating agents which have been used heretofore for polymer films include mineral nucleating agents and organic nucleating agents. Examples of mineral nucleating agents include carbon black, silica, kaolin and talc. Among the organic nucleating agents which have been suggested as useful in polyolefin films include salts of aliphatic mono-basic or di-basic acids or arylalkyl acids such as sodium succinate, sodium glutarate, sodium caproate, sodium 4-methylvalerate, aluminum phenyl acetate, and sodium cinnamate. Alkali metal and aluminum salts of aromatic and alicyclic carboxylic acids such as aluminum benzoate, sodium or potassium benzoate, sodium betanaphtholate, lithium benzoate and aluminum tertiary-butyl benzoate also are useful organic nucleating agents. Substituted sorbitol derivatives such as bis (benzylidene) and bis (alkylbenzilidine) sorbitols wherein the alkyl groups contain from about 2 to about 18 carbon atoms are useful nucleating agents. More particularly, sorbitol derivatives such as 1,3,2,4-dibenzylidene sorbitol, 1,3,2,4-di-para-methylbenzylidene sorbitol, and 1,3,2,4-di-para-methylbenzylidene sorbitol are effective nucleating agents for polypropylenes. Useful nucleating agents are commercially available from a number of sources. MILLAD® 8C-41-10, (a concentrate of 10% MILLAD® 3988 and 90% polypropylene), MILLAD® 3988 and MILLAD® 3905 are sorbitol nucleating agents available from Milliken Chemical Co.

The amounts of nucleating agent incorporated into the film formulations of the present invention generally range from about 100 to about 6000 ppm of the film. In another embodiment, the amount of nucleating agent is in the range of about 1000 to about 5000 ppm, or of about 1500 to 3500 ppm, or of about 2000 to 2500 ppm.

In one embodiment, it is desirable that the front surface of the face film can be printed or adapted to be printed with inks using printing techniques such as flexographic printing, screen printing, offset lithography, letter press, thermal transfer, etc., and that the applied ink has acceptable adhesion to the surface of the face film. The front surface of the face film can be printed before or after the multilayer film is embossed.

Other Adhesives

In one embodiment, the release surface is a separate sheet which is adhered to the main body portion or to the extended body portion by a second adhesive. In one embodiment, the second adhesive has a peel strength which is greater than one pound per inch. In one embodiment, the second adhesive has a peel strength which is greater than two pounds per inch, or greater than 2.5 pounds per inch or greater than 4 pounds per inch.

In one embodiment, the releasable adhesive adheres to the main body portion or to the extended body portion with a peel strength greater than one pound per inch. In one embodiment, the releasable adhesive adheres to main body portion or to the extended body portion with a peel strength which is greater than two pounds per inch, or greater than 2.5 pounds per inch, or greater than 4 pounds per inch.

In one embodiment, the releasable adhesive is adhered to a second sheet member, and the second sheet member is adhered to the main body portion or to the extended body portion by a third adhesive. In one embodiment, the third adhesive is the same adhesive as the second adhesive. In one embodiment, both the second and third adhesives are an acrylic emulsion PSA sold under the tradename S-490 by the Fasson Division of the Avery Dennison Corporation.

In one embodiment, the second and third adhesives, and any adhesive used to close the bottom or other normally closed portions of the bag or container, provide a permanent adherence of the attached parts. The peel strength of these adhesives is greater than about 1 lb/in, or about 2 lb/in, or about 5 lb/in, or about 10 lb/in. In one embodiment, the peel strength of the other adhesive may be such that the substrate is damaged prior to the adhesive peeling. For example, the adherence of the release surface material and the second sheet member to the outer surface of the bag or container are intended to form permanent bonds. The following disclosure with respect to the second and third adhesives specifically refers to these adhesives, but also is intended to apply to any other adhesive used for other closures in the bag or container to which the present invention is applied, such as the bag bottom and the part of the bag top which is not to be opened and reclosed.

The adhesives used as the second and third adhesives in the present invention may be the same or different. The adhesives useful as the second and third adhesives may be a heat-activated adhesive, a hot melt adhesive, or a pressure sensitive adhesive (PSA). Adhesives which are tacky at any temperature up to about 160° C. (about 320° F.) are particularly useful. PSAs which are tacky at ambient temperatures are particularly useful as the second and third adhesives in the present invention. A variety of conventional PSAs can be utilized provided that the viscosity is or can be modified to be similar to the viscosity of the polymeric film material which is being coextruded with the adhesive. Useful PSA compositions are fluid or pumpable at the temperatures used in the melt processing. Also, the adhesive compositions should not significantly degrade or gel at the temperature employed and over the time required for melt processing and extrusion. Typically, the adhesive compositions have a viscosity of from 1000 poise to 1,000,000 poise at the processing temperature.

In one embodiment, the adhesive used for the second and third adhesives, as well as other adhesives, is an acrylic emulsion PSA sold under the tradename S-490 by from the Fasson Division of Avery Dennison Corporation.

The adhesives useful as the second and third adhesives may generally be classified into the following categories:

(a) random copolymer adhesives such as those based upon acrylate and/or methacrylate copolymers, α-olefin copolymers, silicone copolymers, chloroprene/acrylonitrile copolymers, and the like;

(b) block copolymer adhesives including those based upon linear block copolymers (i.e., A-B and A-B-A type), branched block copolymers, star block copolymers, grafted or radial block copolymers, and the like; and (c) natural and synthetic rubber adhesives.

A description of useful pressure-sensitive adhesives may be found in *Encyclopedia of Polymer Science and Engineering*, Vol. 13. Wiley-Interscience Publishers (New York, 1988). Additional description of useful pressure-sensitive adhesives may be found in *Encyclopedia of Polymer Science and Technology*, Vol. 1, pp. 476–546, Wiley-Interscience Publishers, 2nd Ed. (New York, 1985)

Commercially available pressure-sensitive adhesives are useful as the second and third adhesives in the invention. Examples of these adhesives include the hot melt pressure-sensitive adhesives available from H. B. Fuller Company, St. Paul, Minn. as HM-1597, HL-2207-X, HL-2115-X, HL-2193-X. Other useful commercially available pressure-sensitive adhesives include those available from Century Adhesives Corporation, Columbus, Ohio.

Conventional PSAs, including silicone-based PSAs, rubber-based PSAs, and acrylic-based PSAs are useful as the second and third adhesives.

The pressure sensitive adhesive materials that are useful can be in the form of solutions or emulsions, or they can be in the form of hot melt adhesives. The pressure sensitive adhesives may contain as a major constituent an adhesive polymer such as natural, reclaimed or styrene butadiene rubber, tackified natural or synthetic rubbers, styrene butadiene or styrene isoprene block copolymers, random copolymers of ethylene and vinyl acetate, ethylene-vinyl-acrylic terpolymers, polyisobutylene, poly(vinyl ether), poly (acrylic) ester, etc. The pressure sensitive adhesive materials are typically characterized by glass transition temperatures in the range of about −70° C. to about 10° C.

The acrylic adhesives may contain as a major constituent acrylic type polymers containing carboxylic acids which are obtained from vinyl type monomers containing carboxyl groups such as acrylic acid, methacrylic acid, etc., and acrylic type polymers containing hydroxyl groups which are obtained from vinyl type monomers containing hydroxyl groups such as 2-hydroxyethyl methacrylate, etc. In one embodiment, the acrylic adhesive material is obtained from the copolymerization of an alkyl acrylate such as butyl acrylate, 2-ethylhexyl acrylate, or isononyl acrylate; a polar monomer such as acrylic acid, acrylamide, or N-vinyl-2-pyrrolidone, and another monomer such as an acrylate other than the acrylate mentioned above, methacrylate, styrene, vinyl acetate, etc.

In one embodiment, the pressure sensitive adhesive utilized as the second and third adhesives in the present invention comprise rubber-based elastomer materials such as linear, branched, graft or radial block copolymers represented by the diblock structures A-B, the triblock A-B-A, the radial or coupled structures $(A\text{-}B)_n$, and combinations of these where A represents a hard thermoplastic phase or block which is non-rubbery or glassy or crystalline at room temperature but fluid at higher temperatures, and B represents a soft block which is rubbery or elastomeric at service or room temperature. These thermoplastic elastomers may comprise from about 75% to about 95% by weight of rubbery segments and from about 5% to about 25% by weight of non-rubbery segments.

The non-rubbery segments or hard blocks comprise polymers of mono- and polycyclic aromatic hydrocarbons, and more particularly vinyl-substituted aromatic hydrocarbons which may be monocyclic or bicyclic in nature. The preferred rubbery blocks or segments are polymer blocks of homopolymers or copolymers of aliphatic conjugated dienes. Rubbery materials such as polyisoprene, polybutadiene, and styrene butadiene rubbers may be used to form the rubbery block or segment. Particularly preferred rubbery segments include polydienes and saturated olefin rubbers of ethylene/butylene or ethylene/propylene copolymers. The latter rubbers may be obtained from the corresponding unsaturated polyalkylene moieties such as polybutadiene and polyisoprene by hydrogenation thereof.

The block copolymers of vinyl aromatic hydrocarbons and conjugated dienes which may be utilized include any of those which exhibit elastomeric properties. The block copolymers may be diblock, triblock, multiblock, star-block, polyblock or graftblock copolymers. Throughout this specification and claims, the terms diblock, triblock, multiblock, polyblock, and graft or grafted-block with respect to the structural features of block copolymers are to be given their normal meaning as defined in the literature such as in the *Encyclopedia of Polymer Science and Engineering*, Vol. 2, (1985) John Wiley & Sons, Inc., New York, pp. 325–326, and by J. E. McGrath in *Block Copolymers, Science Technology*, Dale J. Meier, Ed., Harwood Academic Publishers, 1979, at pages 1–5.

Such block copolymers may contain various ratios of conjugated dienes to vinyl aromatic hydrocarbons including those containing up to about 40% by weight of vinyl aromatic hydrocarbon. Accordingly, multi-block copolymers may be utilized which are linear or radial symmetric or asymmetric and which have structures represented by the formulae A-B, A-B-A, A-B-A-B, B-A-B, $(AB)_{0,1,2}\ldots BA$, etc., wherein A is a polymer block of a vinyl aromatic hydrocarbon or a conjugated diene/vinyl aromatic hydrocarbon tapered copolymer block, and B is a rubbery polymer block of a conjugated diene.

The block copolymers may be prepared by any of the well-known block polymerization or copolymerization procedures including sequential addition of monomer, incremental addition of monomer, or coupling techniques as illustrated in, for example, U.S. Pat. Nos. 3,251,905; 3,390,207; 3,598,887; and 4,219,627. As is well known, tapered copolymer blocks can be incorporated in the multi-block copolymers by copolymerizing a mixture of conjugated diene and vinyl aromatic hydrocarbon monomers utilizing the difference in their copolymerization reactivity rates. Various patents describe the preparation of multi-block copolymers containing tapered copolymer blocks including U.S. Pat. Nos. 3,251,905; 3,639,521; and 4,208,356, the disclosures of which are hereby incorporated by reference.

Conjugated dienes which may be utilized to prepare the polymers and copolymers are those containing from 4 to about 10 carbon atoms and more generally, from 4 to 6 carbon atoms. Examples include from 1,3-butadiene, 2-methyl-1,3-butadiene (isoprene), 2,3-dimethyl-1,3-butadiene, chloroprene, 1,3-pentadiene, 1,3-hexadiene, etc. Mixtures of these conjugated dienes also may be used. The preferred conjugated dienes are isoprene and 1,3-butadiene.

Examples of vinyl aromatic hydrocarbons which may be utilized to prepare the copolymers include styrene and the various substituted styrenes such as o-methylstyrene, p-methylstyrene, p-tert-butylstyrene, 1,3-dimethylstyrene, alpha-methylstyrene, beta-methylstyrene, p-isopropyl-styrene, 2,3-dimethylstyrene, o-chlorostyrene, p-chlorostyrene, o-bromosty-rene, 2-chloro-4-methylstyrene, etc. The preferred vinyl aromatic hydrocarbon is styrene.

Many of the above-described copolymers of conjugated dienes and vinyl aromatic compounds are commercially available. The number average molecular weight of the block copolymers, prior to hydrogenation, is from about 20,000 to about 500,000, preferably from about 40,000 to about 300,000.

The average molecular weights of the individual blocks within the copolymers may vary within certain limits. In most instances, the vinyl aromatic block will have a number average molecular weight in the order of about 2000 to about 125,000, or between about 4000 and about 60,000. The conjugated diene blocks either before or after hydrogenation will have number average molecular weights in the order of about 10,000 to about 450,000, or from about 35,000 to about 150,000.

Also, prior to hydrogenation, the vinyl content of the conjugated diene portion generally is from about 10% to about 80%, and the vinyl content is from about 25% to about 65%, or particularly from about 35% to about 55% when it is desired that the modified block copolymer exhibit rubbery elasticity. The vinyl content of the block copolymer can be measured by means of nuclear magnetic resonance.

Specific examples of diblock copolymers include styrene-butadiene (SB), styrene-isoprene (SI), and the hydrogenated derivatives thereof. Examples of triblock polymers include styrene-butadiene-styrene (SBS), styrene-isoprene-styrene (SIS), alpha-methylstyrene-butadiene-alpha-methylstyrene, and alpha-methylstyrene-isoprene alpha-methylstyrene. Examples of commercially available block copolymers useful as the adhesives in the present invention include those available from Kraton Polymers and listed in the following Table II.

TABLE II

| KRATON ® | Type | Styrene/Rubber Ratio (w) | % S1 | Melt Index |
|---|---|---|---|---|
| D1101 | Linear SBS | 31/69 | — | <1 |
| D1107P | Linear SIS/SI | 15/85 | 20 | 11 |
| D1111 | Linear SIS | 22/78 | — | 3 |
| D1112P | Linear SIS/SI | 15/85 | 40 | 23 |
| D1113P | Linear SIS/SI | 16/84 | 50 | 24 |
| D1117P | Linear SIS | 17/83 | — | 33 |
| D1320X | Multi-arm $(SI)_n$ | 10/90 | — | NA |

VECTOR® 4111 is an SIS block copolymer available from Dexco of Houston Tex. VECTOR® 4113 is an SIS/SI polymer containing 18% 51 and VECTOR® 4114 also is an SIS/SI polymer which contains 42% SI.

Upon hydrogenation of the SBS copolymers comprising a rubbery segment of a mixture of 1,4 and 1,2 isomers, a styrene-ethylene-butylene styrene (SEBS) block copolymer is obtained. Similarly, hydrogenation of an SIS polymer yields a styrene-ethylene propylene-styrene (SEPS) block copolymer. An example of a commercially available SEPS block copolymer is KRATON® G-1730.

The selective hydrogenation of the block copolymers may be carried out by a variety of well known processes including hydrogenation in the presence of such catalysts as Raney nickel, noble metals such as platinum, palladium, etc., and soluble transition metal catalysts. Suitable hydrogenation processes which can be used are those wherein the diene-containing polymer or copolymer is dissolved in an inert hydrocarbon diluent such as cyclohexane and hydrogenated by reaction with hydrogen in the presence of a soluble hydrogenation catalyst. Such procedures are described in U.S. Pat. Nos. 3,113,986 and 4,226,952, the disclosures of which are incorporated herein by reference. Such hydrogenation of the block copolymers which are carried out in a manner and to extent as to produce selectively hydrogenated copolymers having a residual unsaturation content in the polydiene block of from about 0.5% to about 20% of their original unsaturation content prior to hydrogenation.

In one embodiment, the conjugated diene portion of the block copolymer is at least 90% saturated and more often at least 95% saturated while the vinyl aromatic portion is not significantly hydrogenated. Particularly useful hydrogenated block copolymers are hydrogenated products of the block copolymers of styrene-isoprene-styrene such as a styrene-(ethyl-ene/propylene)-styrene block polymer. When a polystyrene-polybutadiene—polystyrene block copolymer is hydrogenated, it is desirable that the 1,2-polybutadiene to 1,4-polybutadiene ratio in the polymer is from about 30:70 to about 70:30. When such a block copolymer is hydrogenated, the resulting product resembles a regular copolymer block of ethylene and 1-butene (EB). As noted above, when the conjugated diene employed as isoprene, the resulting hydrogenated product resembles a regular copolymer block of ethylene and propylene (EP).

A number of selectively hydrogenated block copolymers are available commercially from Shell Chemical Company under the general trade designation "KRATON® G." One example is KRATON® G1652 which is a hydrogenated SBS triblock comprising about 30% by weight of styrene end blocks and a midblock which is a copolymer of ethylene and 1-butene (EB). A lower molecular weight version of G1652 is available from Shell under the designation KRATON® G1650. KRATON® G1651 is another SEBS block copolymer which contains about 33% by weight of styrene. KRATON® G1657 is an SEBS diblock copolymer which contains about 13% w styrene. This styrene content is lower than the styrene content in KRATON® G1650 and KRATON® G1652. KRATON® RP6919 is a SEBSI block copolymer.

In another embodiment, the selectively hydrogenated block copolymer is of the formula $$B_n(AB)_pA_q$$

wherein n=0 or 1;

p is 1 to 100;

q is 0 or 1;

each B prior to hydrogenation is predominantly a polymerized conjugated diene hydrocarbon block having a number average molecular weight of about 20,000 to about 450,000;

each A is predominantly a polymerized vinyl aromatic hydrocarbon block having a number average molecular weight of from about 2000 to about 115,000; the blocks of A constituting about 5% to about 95% by weight of the copolymer; and the unsaturation of the block B is less than about 10% of the original unsaturation. In other embodiments, the unsaturation of block B is reduced upon hydrogenation to less than 5% of its original value, and the average unsaturation of the hydrogenated block copolymer is reduced to less than 20% of its original value.

The block copolymers may also include functionalized polymers such as may be obtained by reacting an alpha, beta-olefinically unsaturated monocarboxylic or dicarboxylic acid reagent onto selectively hydrogenated block copolymers of vinyl aromatic hydrocarbons and conjugated dienes as described above. The reaction between the carboxylic acid reagent in the graft block copolymer can be effected in solutions or by a melt process in the presence of a free radical initiator.

The preparation of various selectively hydrogenated block copolymers of conjugated dienes and vinyl aromatic hydrocarbons which have been grafted with a carboxylic acid reagent is described in a number of patents including U.S. Pat. Nos. 4,578,429; 4,657,970; and 4,795,782, and the disclosures of these patents relating to grafted selectively hydrogenated block copolymers of conjugated dienes and vinyl aromatic compounds, and the preparation of such compounds are hereby incorporated by reference. U.S. Pat. No. 4,795,782 describes and gives examples of the preparation of the grafted block copolymers by the solution process and the melt process. U.S. Pat. No. 4,578,429 contains an example of grafting of KRATON® G1652 (SEBS) polymer with maleic anhydride with 2,5-dimethyl-2,5-di(t-butylperoxy) hexane by a melt reaction in a twin screw extruder.

Examples of commercially available maleated selectively hydrogenated copolymers of styrene and butadiene include KRATON FG1901X, FG1921X, and FG1924X from Shell, often referred to as maleated selectively hydrogenated SEBS copolymers. FG1901X contains about 1.7% w bound functionality as succinic anhydride and about 28% wt of styrene. FG1921X contains about 1% wt of bound functionality as succinic anhydride and 29% wt of styrene. FG1924X contains about 13% styrene and about 1% bound functionality as succinic anhydride.

Useful block copolymers also are available from Nippon Zeon Co., 2-1, Marunochi, Chiyoda-ku, Tokyo, Japan. For example, QUINTAC® 3530 is available from Nippon Zeon and is believed to be a linear styrene-isoprene-styrene block copolymer.

Other examples of useful commercially available adhesive or adhesive components include: hot melt rubber-based PSAs S-246, C-2500 and C-2110 from the Fasson Division of Avery Dennison Corporation; hot melt PSAs from National Starch under the designation DURO-TAK® 34-424A; low molecular weight polyisobutylene polymers such as VISTANEX® LM-MS-LC, VISTANEX® LM-MM-LC and VISTANEX® LM-MH-LC from Exxon Chemical Company; low density polyethylene such as LD509 from Exxon-Mobil; EVA such as UE 639-67 (containing 28% VA) available from Equistar Chemicals LP, Houston, Tex.; etc.

As mentioned above, in one embodiment, the adhesive compositions used as the second and third adhesives comprise thermoplastic elastomers comprising at least one thermoplastic elastomeric block copolymer which include linear, branched, graft or radial block copolymers. In addition, the adhesives may also contain at least one solid tackifier resin component. A solid tackifier is defined herein as one having a softening point above 80° C. When the solid tackifier resin component is present, the pressure-sensitive adhesive compositions generally comprise from about 40% to about 80% by weight of a thermoplastic elastomer component and from about 20% to about 60% by weight (or from about 55 to 65% by weight) of a solid tackifier resin component. The solid tackifier reduces the modulus of the mixture sufficiently to build tack or adhesion. Also, solid tackifiers (particularly the higher molecular weight solid tackifiers (e.g., MW greater than 2000) and those having a lower dispersity (Mw/Mn=less than about 3)) are less sensitive to migration into the polymer film layer, and this is desirable, since migration of tackifier into the polymer film layer causes dimensional instability, and the adhesive layers can swell and/or wrinkle, and may become too soft. In addition, the adhesive layers may lose adhesive properties or cause blocking, and the ability of the polymer film to be printed satisfactorily may be reduced by migration of the tackifier. For example, attempts to print the polymeric film layer after migration of tackifier or other components from the adhesive layer may result in poor anchorage of the ink and/or blurring of the printing. Migration of the tackifier and other components present in the adhesive layer is a particular problem when the polymer film comprises a polyolefin such as polyethylene.

Conventional solid tackifier resins include hydrocarbon resins, rosin, hydrogenated rosin, rosin esters, polyterpene resins, and other resins which exhibit the proper balance of properties. A variety of useful solid tackifier resins are available commercially such as terpene resins which are sold under the trademark ZONATAC® by Arizona Chemical Company, and petroleum hydrocarbons resins such as the resins sold under the trademark ESCOREZ® by Exxon Chemical Company. One particular example of a useful solid tackifier is ESCOREZ® 2596 which is a $C_5$–$C_9$ (aromatic modified aliphatic) synthetic tackifier having an Mw of 2100 and a dispersity (Mw/Mn) of 2.69. Another useful solid tackifier is ESCOREZ® 1310LC, identified as an aliphatic hydrocarbon resin having an Mw of 1350 and a dispersity of 1.8. WINGTACK® 95 is a synthetic tackifier resin available from Goodyear, Akron, Ohio consisting predominantly of polymerized structure derived from piperylene and isoprene. REGALREZ® 1094 and REGALREZ® 6108 are hydrogenated solid tackifiers available from Hercules. The adhesive compositions also may include one or more hydrogenated liquid tackifiers such as REGALREZ® 1018 from Hercules. The amount of the hydrogenated liquid tackifier included in the adhesive compositions may range from about 0.1 to about 20% by weight based on the weight of resin or rubber in the adhesive. In another embodiment, from about 5% to about 15% by weight of the hydrogenated liquid tackifier is included in the adhesive formulations.

The adhesives also may include other materials such as antioxidants, heat and light stabilizers, ultraviolet light absorbers, viscosity modifiers, fillers, colorants, antiblocking agents, reinforcing agents, processing acids, mineral oil, etc. Hindered phenolic and amine antioxidant compounds may be included in the adhesive compositions, and a wide variety of such antioxidant compounds are known in the art.

The amount of antioxidant can be varied, and in one embodiment from about 0.01 to about 1% by weight or more, based on the total weight of resin and rubber in the adhesive, is used. A variety of antioxidants are available from Ciba-Geigy under the general trade designations "IRGANOX®" and "IRGAFOS®". For example, the hindered phenolic antioxidant n-octadecyl 3-(3,5-di-t-butyl-4-hydroxyphenol)-propionate is available under the general trade designation "IRGANOX® 1076". IRGANOX® 1010, is identified as tetrakis (methylene 3-(3',5'-di-tert-butyl-4'-hydroxyphenol) propionate) methane. IRGAFOS® 168 is another useful antioxidant from Ciba-Geigy.

Hydroquinone-based antioxidants also may be utilized, and one example of such an antioxidant is 2,5-di-tertiary-amyl-hydroquinone.

Light stabilizers, heat stabilizers, and UV absorbers also may be included in the adhesive compositions. Ultraviolet absorbers include benzotriazole derivatives, hydroxy benzyl phenones, esters of benzoic acids, oxalic acid, diamides, etc. Light stabilizers include hindered amine light stabilizers, and the heat stabilizers include dithiocarbamate compositions such as zinc dibutyl dithiocarbamate.

The adhesives may also contain mineral oil such as white mineral oil in amounts of from about 0.01 to about 15 or 20% by weight. In one embodiment, the adhesive formulation contains from about 5% to about 15% by weight of a mineral oil. An example of a useful commercial white mineral oil is Kaydol Oil from Witco Chemical.

The adhesives may contain inorganic fillers and other organic and inorganic additives to provide desired properties. Examples of useful fillers include calcium carbonate, titanium dioxide, metal particles, fibers, etc. An example of a useful end-block reinforcing agent is CUMAR® LX509 from Neville Resins.

Recloseable Containers

The resealable closures of the present invention may be applied to containers such as flexible bags or rigid boxes. The containers may be made of single or multiple layers of, e.g., paper, polymer or composites of paper and polymer, or of other materials such as cardboard, metal foils or metallized polymers. In one embodiment, the container is a flexible bag formed of multiple layers of paper. The paper may be light, medium or heavy weight, with heavy weight paper typically used. There can be from two to about eight layers with three layers being typical. In another embodiment, the container is a flexible bag formed of multiple layers of heavy weight paper, in which the inner layer includes an inner, product-facing poly-lined surface. The innermost layer of the bag, which is exposed to the product contained in the bag, may be paper lined with a polymer on the side facing the product. This feature avoids penetration into the paper of components of the product, such as oils or fats from foods. The inner, polymer-lined layer may also be used to add strength to the container as a whole. In another embodiment, the container is a flexible bag formed of multiple layers of paper, in which the outer layer includes an outer-facing polymer-lined surface. The outer-facing polymer-lined surface may be used to protect the bag as a whole from environmental effects, including moisture, dirt, oils, physical damage, etc.

When the recloseable container is a flexible bag, one or more of the layers may be formed of paper. Although paper of any weight can be employed as a substrate material, paper having weights in the range of from about 30 to about 150 pounds per ream are useful, or from about 40 to about 120 pounds per ream are useful. In one embodiment, the paper is 100 pound paper, or 80 pound paper, or 60 pound paper, or 50 pound paper. IN one embodiment, the paper is greater than 45 pound paper, or greater than 55 pound paper. As used herein, weights of paper are given in pounds per ream, and a ream is defined as 3000 square feet ($ft^2$). Thus, for example, for 30 pound paper, one ream of the paper weighs 30 pounds (13.64 kg). Examples of specific papers that can be used include 41-pound offset grade bleached kraft paper; 78-pound bleached kraft paper, etc., in the range from 30 pound to 150 pound paper.

In one embodiment, the outer surface of the flexible bag is a semi-gloss elite paper stock, having a weight of at least about 45 pounds. In another embodiment, the outer surface of the flexible bag is semi-gloss elite paper stock having a weight of at least about 60 pounds. In another embodiment, the paper is semi-gloss coated one-side bleached kraft face paper stock, having a weight of at least about 30 pounds. In another embodiment, the outer surface of the flexible bag is polycoated paper stock having a weight of at least about 50 pounds.

Containers, including both bags and boxes, made of paper or paper-based substrates are particularly useful because of the wide variety of applications in which they can be employed. Paper is also relatively inexpensive and has desirable properties including antiblocking, antistatic, and dimensional stability. Paper can potentially be recycled. Any type of paper, having sufficient tensile strength to be handled in conventional paper coating and treating apparatus and to reliably hold for storage, handling and transportation the desired contents, can be employed as the substrate. Thus, any type of paper can be used depending upon the end use and particular users' preferences. Included among the types of paper which can be used are clay coated paper, glassine, polymer coated paper, paperboard from straw, bark, wood, cotton, flax, cornstalks, sugarcane, bagasse, bamboo, hemp, and similar cellulose materials prepared by such processes as the soda, sulfite or sulfate (kraft) processes, the neutral sulfide cooking process, alkali-chlorine processes, nitric acid processes, semi-chemical processes, etc.

Alternatively, the substrate for the recloseable container may be a polymer film. Examples of polymer films include those disclosed above with respect to the release surface. In addition to these polymers, any of the polymers and copolymers disclosed above may be employed, and may be suitably selected with due consideration to cost, application, availability, etc. For example, the polyolefin films may comprise homopolymers and copolymers of monoolefins having from 2 to about 12 carbon atoms, or from 2 to about 8 carbon atoms, or from 2 to about 4 carbon atoms per molecule. Examples of such homopolymers include polyethylene, polypropylene, poly-1-butene, etc. The examples of copolymers within the above definition include copolymers of ethylene with from about 1% to about 10% by weight of propylene, copolymers of propylene with about 1% to about 10% by weight of ethylene or 1-butene, etc. Films prepared from blends of copolymers or blends of copolymers with homopolymers also are useful. The polymer films may be extruded in mono- or multilayers.

When the recloseable container is a flexible bag, the bag may be formed of a layer of polymer sheeting. Suitable polymers include any of the polymers identified above for use in forming the bag materials or for use with the releasable closure, or known for use in such applications. While a single layer is generally adequate, in appropriate circumstances multiple layers of polymer sheeting may be used. In another embodiment, the bag may be formed of a layer of plastic sheeting and one or more additional layers of, e.g., paper.

Another type of material which can be used as the substrate is a polycoated kraft liner which includes a kraft liner that is coated on either or both sides with a polymer coating. The polymer coating, may include any of the above-described polymers, for example, high, medium, or low density polyethylene, propylene, polyester, and other similar polymer films. The polymer is coated onto the substrate surface to add strength and/or dimensional stability to the substrate. The weights of these substrates typically range from about 30 to about 100 pounds per ream, or from about 40 to about 94 pounds per ream. In total, the final substrate typically includes between about 10% and about 40% polymer and from about 60% to about 90% paper. For two sided coatings, the quantity of polymer is approximately evenly divided between the top and bottom surface of the paper.

In one embodiment, the recloseable container may be a carton, a box or a box-like enclosure. An example of such a container is a plastic-wrap container/dispenser. In an embodiment, the container may be rigid rather than flexible. The carton or box may be made of cardboard, paperboard or similar material.

The recloseable container may comprise both a carton or box and a flexible inner liner, as in a breakfast cereal box. In such an embodiment, either the inner, flexible container or the outer, rigid carton or box, or both, may include a resealable closure in accordance with the present invention.

The recloseable containers to which the present invention may be applied may include heavy-duty bags made from multi-ply high strength polyolefins, such as LDPE polyethylene, as well as other woven or nonwoven, synthetic or natural web materials. Such bags are typically used to package materials such as dry cement, salt, potting soil, small landscaping rocks, pet food and similar heavy materials.

The face layer or layers of the bag liner or bag outer surface may comprise a major amount of a thermoplastic copolymer or terpolymer derived from ethylene or propylene (preferably ethylene) and a functional monomer selected from the group consisting of alkyl acrylate, acrylic acid, alkyl acrylic acid, vinyl acetate and combinations of two or more thereof. In one embodiment, the above described polymers may be used as the face layer. In one embodiment, the functional monomer is selected from the group consisting of alkyl acrylate, acrylic acid, alkyl acrylic acid, and combinations of two or more thereof. The alkyl groups in the alkyl acrylates and the alkyl acrylic acids typically contain 1 to about 8 carbon atoms, and in one embodiment 1 to about 2 carbon atoms. The copolymer or terpolymer generally has a melting point in the range of about 50° C. to about 120° C., and in one embodiment about 60° C. to about 11° C.

The functional monomer(s) component of the copolymer or terpolymer ranges from about 1 to about 15 mole percent, and in one embodiment about 1 to about 10 mole percent of the copolymer or terpolymer molecule. Examples include: ethylene/vinyl acetate copolymers; ethylene/methyl acrylate copolymers; ethylene/ethylacrylate copolymers; ethylene/butyl acrylate copolymers; ethylene/methacrylic acid copolymers; ethylene/acrylic acid copolymers; ethylene/methacrylic acid copolymers containing sodium or zinc (also referred to as ionomers); acid-, anhydride- or acrylate-modified ethylene/vinyl acetate copolymers; acid- or anhydride-modified ethylene/acrylate copolymers; anhydride-modified low density polyethylenes; anhydride-modified linear low density polyethylene, and mixtures of two or more thereof. In one embodiment, ethylene/vinyl acetate copolymers that are particularly useful include those with a vinyl acetate content of at least about 20% by weight, and in one embodiment about 20% to about 40% by weight, and in one embodiment about 22% to about 28% by weight, and in one embodiment about 25% by weight.

Examples of commercially available copolymers and terpolymers that can be used as the face layers include the ethylene/vinyl acetate copolymers available from DuPont under the tradename ELVAX®. These include ELVAX® 3120, which has a vinyl acetate content of 7.5% by weight and a melting point of 99° C., ELVAX®3124, which has a vinyl acetate content of 9% by weight and a melting point of 77° C., ELVAX®3150, which has a vinyl acetate content of 15% by weight and a melting point of 92° C., ELVAX® 3174, which has a vinyl acetate content of 18% by weight and a melting point of 86° C., ELVAX® 3177, which has a vinyl acetate content of 20% by weight and a melting point of 85° C., ELVAX®3190, which has a vinyl acetate content of 25% by weight and melting point of 77° C., ELVAX® 3175, which has a vinyl acetate content of 28% by weight and a melting point of 73° C., ELVAX® 3180, which has a vinyl acetate content of 28% by weight and a melting point of 70° C., ELVAX®3182, which has a vinyl acetate content of 28% by weight and a melting point of 73° C., and ELVAX® 3185, which has a vinyl acetate content of 33% by weight and a melting point of 61° C., and ELVAX®3190LG, which has a vinyl acetate content of 25% by weight, a melting point of about 77° C. and a glass transition temperature ($T_g$) of about −38.6° C. Ethylene acid copolymers available from DuPont under the tradename NUCREL® can also be used. These include NUCREL® 0407, which has a methacrylic acid content of 4% by weight and a melting point of 109° C., and NUCREL® 0910, which has a methacrylic acid content of 8.7% by weight and a melting point of 100° C. The ethylene/acrylic acid copolymers available from Dow Chemical under the tradename PRIMACOR® are also useful. These include PRIMACOR® 1430, which has an acrylic acid monomer content of 9.5% by weight, a melting point of about 97° C. and a $T_g$ of about −7.7° C. The ethylene/methyl acrylate copolymers available from Chevron under the tradename EMAC® can be used. These include EMAC® 2205, which has a methyl acrylate content of 20% by weight and a melting point of 83° C., and EMAC® 2268, which has a methyl acrylate content of 24% by weight, a melting point of about 74° C. and a $T_g$ of about −40.6° C.

Ionomers (polyolefins containing ionic bonding of molecular chains) also are useful as the face layers. Ionomer resins available from DuPont under the tradename SURLYN® can also be used. These are identified as being derived from sodium, lithium or zinc and copolymers of ethylene and methacrylic acid. These include SURLYN® 1601, which is a sodium containing ionomer having a melting point of 98° C., SURLYN® 1605, which is a sodium containing ionomer having a melting point of about 90° C. and a $T_g$ of about −20.6° C., SURLYN® 1650, which is a zinc containing ionomer having a melting point of 97° C., SURLYN® 1652 which is a zinc containing ionomer having a melting point of 100° C., SURLYN® 1702, which is a zinc containing ionomer having a melting point of 93° C., SURLYN® 1765-1, which is a zinc containing ionomer having a melting point of 95° C., SURLYN® 1707, which is a sodium containing ionomer having a melting point of 92° C., SURLYN® 1802, which is a sodium containing ionomer having a melting point of 99° C., SURLYN® 1855, which is a zinc containing ionomer having a melting point of 88° C., SURLYN® 1857, which is a zinc containing ionomer having a melting point of 87° C., and SURLYN® 1901, which is a sodium containing ionomer having a melting point of 95° C.

Polycarbonates also are useful as the face layer, and these are available from the Dow Chemical Co. (CALIBRE®) G. E. Plastics (LEXAN®) and Bayer (MAKROLON®). Most commercial polycarbonates are obtained by the reaction of bisphenol A and carbonyl chloride in an interfacial process. Molecular weights of the typical commercial polycarbonates vary from about 22,000 to about 35,000, and the melt flow rates generally are in the range of from 4 to 22 g/10 min.

In general, the recloseable container has a main body portion and an integral extended body portion which is foldable over a part of the main body portion. For example, the container may be a bag having a front portion and an extended back portion, in which the extended back portion forms a flap which is foldable over the front portion.

When the recloseable container is a bag, it may have a main body portion and an integral extended body portion which is foldable over a part of the main body portion. The main body of the bag may include a front panel or sheet and a back panel or sheet. One of the front or back panels, usually the back panel, may include an integral extended portion which is longer than the remainder of the bag. The extended portion, such as a flap, is foldable over the main body of the bag. An area of overlap defined by the folded-over flap provides a suitable location for a resealable closure.

EXAMPLES

The following examples illustrate specific pressure sensitive adhesive formulations which are useful in preparing the adhesives for use as the second and third adhesives. Unless otherwise indicated in the following examples, in the claims, and elsewhere in the written description, all parts and percentages are by weight, and temperatures are in degrees centigrade.

The following rubber-based adhesives can be used:

| | |
|---|---|
| PSA-1: | A rubber-resin hot melt general purpose permanent pressure sensitive adhesive having a density of 7.88 lb/gal and a viscosity of 7000–11000 cps @ 350° F. |
| PSA-2: | A rubber-resin hot melt permanent pressure sensitive adhesive for dairy label applications having a density of 8.25 lb/gal and a viscosity of 4500–7500 cps @ 350° F. |
| PSA-3: | A rubber-resin hot melt general purpose permanent pressure sensitive adhesive having a density of 7.8 lb/gal and a viscosity of 14,000–19,000 cps @ 350° F. |
| PSA-4: | A permanent rubber-based emulsion adhesive having a typical service temperature in the range of about −65° F. to about 200° F. This is an aggressive general purpose adhesive. |

The following acrylic adhesives can be used:

| | |
|---|---|
| PSA-5: | Acrylic emulsion pressure sensitive adhesive having a solids content of 60% by weight and a pH of 5.2. An example of this adhesive is the acrylic emulsion PSA sold under the tradename S-490 by the Fasson Division of the Avery Dennison Corporation. |
| PSA-6: | A permanent tackified acrylic emulsion pressure sensitive adhesive having a solids content of 58.5% by weight and a pH of 7.2. |
| PSA-7: | A removable acrylic emulsion pressure sensitive adhesive having a solids content of 61% by weight and a pH of 6.5. |

-continued

| | |
|---|---|
| PSA-8: | A removable acrylic emulsion pressure sensitive adhesive having a solids content of 52% by weight and a pH of 9.2. |
| PSA-9: | A removable acrylic emulsion pressure sensitive adhesive having a solids content of 40% by weight and a pH of 6.6. |
| PSA-10: | A repulpable acrylic emulsion pressure sensitive adhesive having a solids content of 60% by weight. |
| PSA-11: | An acrylic emulsion adhesive having a typical service temperature range of about −65° F. to about 200° F. This adhesive is a permanent adhesive at cold and room temperature conditions after 24 hours. This adhesive is semi-removable when first applied. |

Commercially available acrylic adhesives that can be used include Narcor 38-4542 (a product of National Starch identified as a removable acrylic emulsion pressure sensitive adhesive), E2920 (a product of Rohm & Haas identified as an acrylic emulsion pressure sensitive adhesive), and AROSET® 2555 (a product of Ashland identified as an ultra removable acrylic emulsion pressure sensitive adhesive).

Examples of commercially available pressure sensitive silicone adhesives include PSA825-D1, PSA518-D1 and PSA6574-D1, which are available from GE Silicones.

The coating weight of the second and third pressure sensitive adhesive compositions that are applied to the bag or container is generally in the range of about 0.1 to about 1000 gsm, and in one embodiment about 0.1 to about 500 gsm, or about 0.5 to about 250 gsm, or about 1 to about 100 gsm, or about 1 to about 50 gsm, and or about 2 to about 28 gsm.

In one embodiment, two or more layers of adhesive are applied, one on top of another. In this embodiment, it is convenient to use a separate application means for each adhesive material being applied.

Drawings

Figure 2:
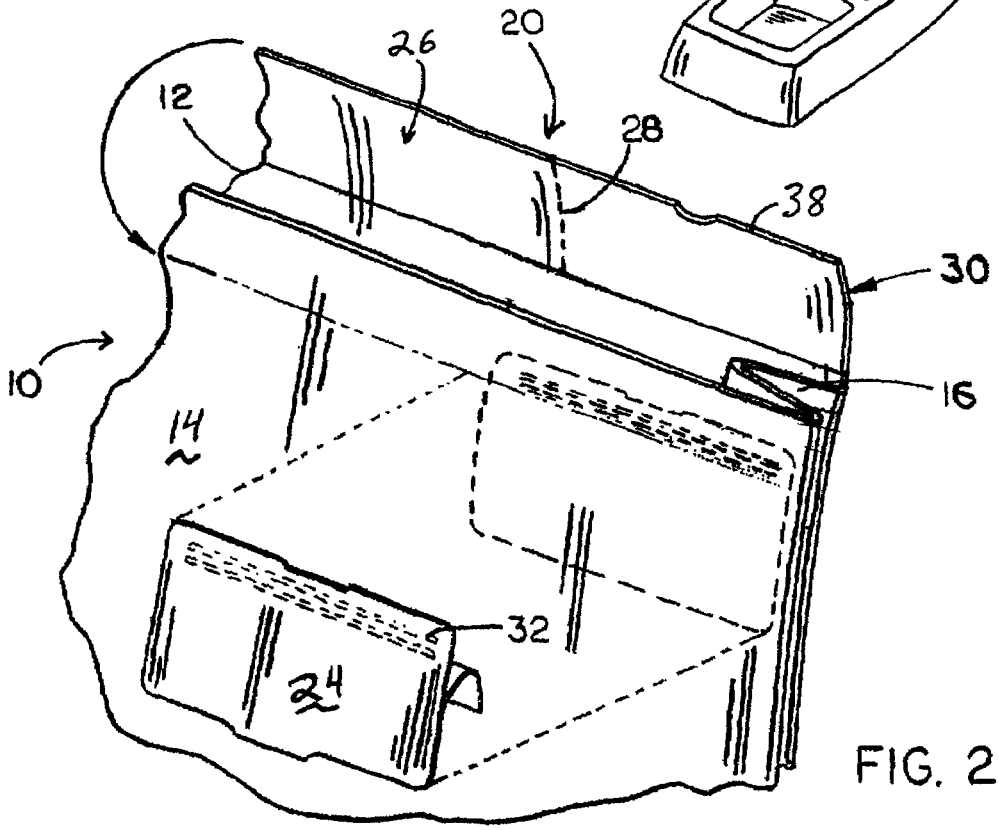
FIG. 2 is a perspective view of a spout of a bag including an embodiment of the resealable closure of FIG. 1.

Referring now to FIGS. 1 and 2, FIG. 1 illustrates in perspective a bag which includes one embodiment of a resealable closure in accordance with the present invention. FIG. 1 illustrates a bag 10, e.g., for dog food, cat food, or other particulate material, which includes a back wall 12, a front wall 14, and optionally a pair of expandable or foldable side walls 16 and 18 which extend between walls 12 and 14. The bag 10 generally has an upper end 20 and a lower end 22. As described above, the bag 10 may comprise one or more layers of paper and/or polymer or other suitable material. Further, as in conventional bags, the lower end 22 of the bag 10 is sealed, usually by folding the lower ends of the front wall 14, the back wall 12, and the side walls 16, 18 upon themselves to form a flap which is permanently glued or sealed to the lower end of the back wall 12 or the front wall 14. The lower end of one of the front or back wall may terminate slightly below the lower ends of the side wall members and the back wall for sealing purposes. The upper end of the front wall 14 and the upper ends of the side walls terminate below the upper end of back wall 12 to form a flap 26 which is positioned adjacent at the upper end of the front wall 14.

FIG. 2 is a perspective view of an opened spout of a bag including an embodiment of the resealable closure of FIG. 1. As shown in more detail in FIG. 2, a resealable closure 24 of this invention may be used with a bag such as described above. The flap 26 is formed from the extended portion of the back wall 12. The flap 26 may include a line of perforations 28, which defines a flap portion 30. In one embodiment, the flap 26, except for the flap portion 30, is adhered to the front wall 14 in conventional fashion. When opened, the flap portion 30 forms a spout through which a portion of the contents of the bag may be removed.

In one embodiment, a glue line 32 is provided either on the inside surface of the flap portion 30, or on the outer surface of the resealable closure 24, as shown in FIG. 2. In this embodiment, the glue line 32 enables the resealable closure 24 to be adhered to the flap portion 30. In this embodiment, the resealable closure 24 forms an extension of the flap portion 24, and will be visible on the front wall 14 when the bag 10 is manufactured, shipped, stored and used. In this embodiment, it may be useful to provide a protective cover (not shown) for that portion of the resealable closure 24 which extends beyond the flap portion 30 and is exposed.

In one embodiment, described below, the glue line 32 shown in FIG. 2 is expanded to cover substantially the entire surface of the resealable closure 24, such that when the flap portion 30 is adhered thereto, substantially all of the resealable closure 24 is covered by the flap portion 30. In one embodiment, the resealable closure 24 does not extend beyond a terminal edge 38 of the flap portion 30. Thus, the flap portion may cover from about 95% to 100% of the resealable closure 24. In this embodiment, the resealable closure 24 is completely covered by the flap portion 30. In another embodiment, the glue line 32 shown in FIG. 2 is applied to cover from about 80% to about 95% of the area, in which case, when the flap portion 30 is adhered thereto, the flap portion 30 covers from about 80% to about 95% of the resealable closure 24. In this alternative embodiment, only a small part, such as about 5% to about 20%, of the resealable closure 24 exposed. Such embodiments are shown and described below in relation to FIGS. 9–16. In one embodiment, the flap portion 30 is directly adhered to a release surface by an adhesive. In such embodiments, the exposed portion of the resealable closure 24 assists the user in identifying on which side of the bag 10 the spout is located.

In one embodiment, the lower end 38 of the flap portion 30 extends beyond the lower edge of the resealable closure 24. Such an embodiment is shown in FIGS. 3 and 6–8. As shown in these figures, a "no-adhesive" or adhesive-free area 36 is formed at the lower edge 38 of the flap portion 30.

Although the resealable closure 24 is illustrated as being positioned at the upper end of the bag, the resealable closure 24 could be provided at the lower end of the bag if so desired.

In one embodiment, the flap 26 does not include a line of perforations, so that the entire width of the flap 26 may be included as part of the resealable closure 24. In such an embodiment, the entire flap 26 constitutes the flap portion 30, and may be used as a single opening in the bag 10.

In an alternative embodiment, the user may cut the flap 26 at any selected location along the width of the flap 26, to create a flap portion 30 of any desired size. For example, once the bag is opened, the user may elect to cut the flap 26 at a location such as the perforation line 28 or at another selected location on the flap 26, to create a flap portion 30. If the user intends to withdraw relatively small portions each time the contents of the bag 10 are to be used, the flap may be cut at a location closer to the right-hand end of the bag 10 shown in FIG. 2.

As shown in the drawings, the resealable closure 24 may be generally rectangular in shape, although other shapes may also be utilized. The rectangular shape is merely used as a convenient, non-limiting example.

The embodiment shown in FIG. 2 includes a resealable closure 24 having a size appropriate to work with the flap portion 30. In one alternative embodiment described above, in which the entirety of the flap 26 forms the flap portion 30, the resealable closure 24 may extend across the entire width of the front wall of the bag 10. In general, the width of the resealable closure 24 should approximate the width of the flap portion 30. In one embodiment, the resealable closure 24 extends to the side edge of the bag 10 in which the spout is formed.

Figure 3:
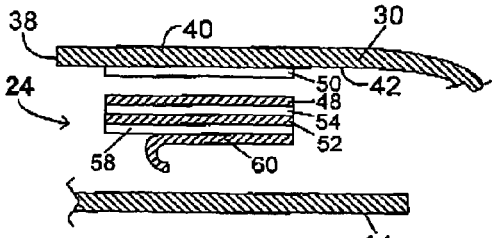
FIG. 3 is a cross-sectional view of an embodiment of the resealable closure during application of the closure to a bag, in accordance with the present invention.
Figure 4:
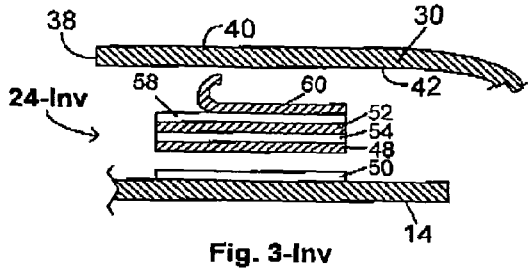
FIG. 4 is a cross-sectional view of the embodiment of the resealable closure of FIG. 3 with the resealable closure in a closed position.
Figure 4:
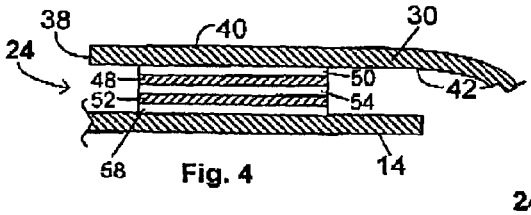
Figure 5:
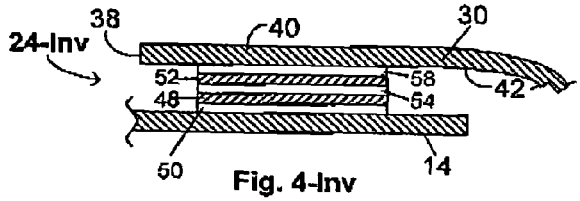
FIG. 5 is a cross-sectional view of the embodiment of the resealable closure of FIG. 3 with the resealable closure in an open position.
Figure 5:
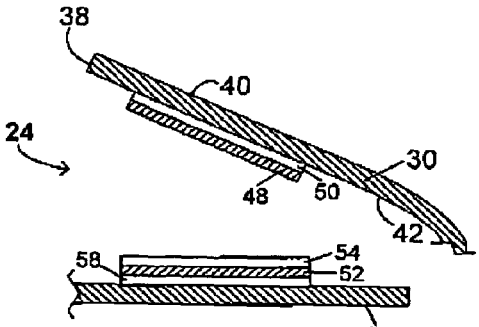

A first embodiment of the resealable closure 24 is shown in FIGS. 3–5. FIG. 3 is a cross-sectional view of an embodiment of the resealable closure during application of the closure to a bag, in accordance with the present invention. FIG. 4 is a cross-sectional view of the embodiment of the resealable closure of FIG. 3 with the resealable closure in a closed position. FIG. 5 is a cross-sectional view of the embodiment of the resealable closure of FIG. 3 with the resealable closure in an open position.

As shown in FIGS. 3–5, in this embodiment the resealable closure 24 includes the flap portion 30 having a lower end 38, a outer surface 40 and an inner surface 42. Since the flap portion 30 may be an extension of the back wall 12, the outer surface 40 may be substantially the same as the outer surface of the back wall 12, as described herein. Similarly, since the inner surface 42 may be an extension of the inner liner of the bag 10, the inner surface may be substantially the same material as the inner liner, as described herein.

The inner surface 42 of the flap portion 30 is secured to a release liner 48 by an adhesive 50. In one embodiment, the release liner 48 is 2.6 mil biaxially oriented polypropylene material. The release liner 48 could have a thickness varying from 1.0 to 4.0 mils and could be manufactured from other materials, as more fully described herein, such as a polyethylene or polystyrene film or blend thereof. In one embodiment, the adhesive 50 is an acrylic emulsion PSA sold under the tradename S490 by the Fasson Division of the Avery Dennison Corporation. This adhesive adhesively secures the flap portion 30 to the release liner 48. In one embodiment, the adhesive 50 is a hot melt rubber-based adhesive. In another embodiment, the adhesive 50 may comprise an acrylic or solvent-based adhesive. In one embodiment, the adhesive 50 has a peel strength which is greater than one pound per inch. In another embodiment, the adhesive 50 has a peel strength in the range from about 1 pound per inch to about 4 pounds per inch, or from about 1.5 pounds per inch to about 3.5 pounds per inch, or from about 2 pounds per inch to about 3 pounds per inch.

Figure 3A:
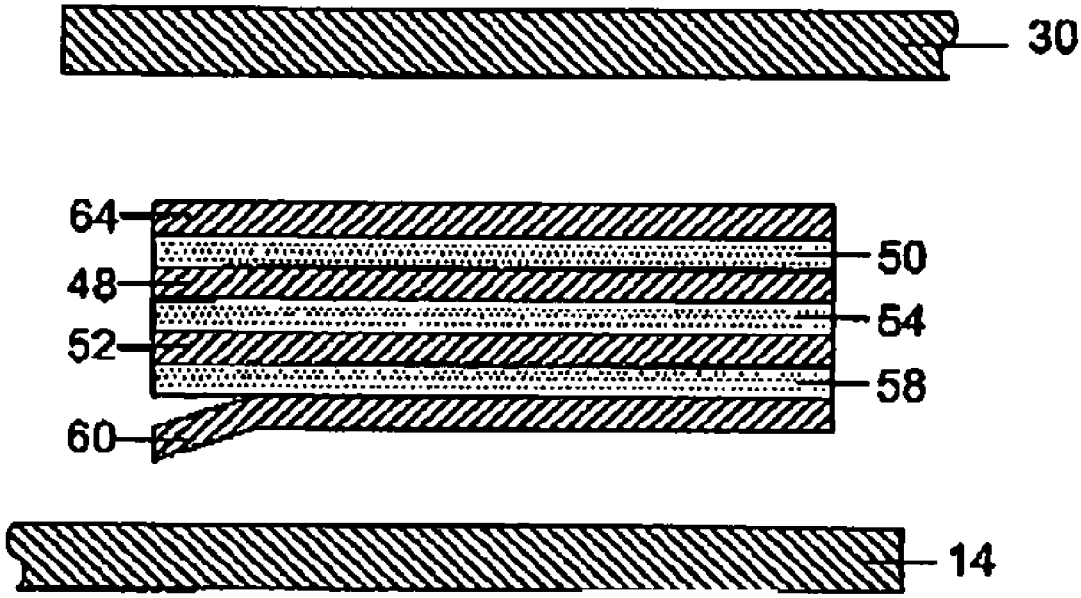
FIG. 3A is a cross-sectional view of an alternate embodiment of the resealable closure of FIG. 3.

In an alternate embodiment of the resealable closure 24, shown in FIG. 3A, the adhesive 50 may be applied first to the release liner 48. In this embodiment, when the resealable closure 24 constructed, but before it has been applied to the bag 10, the adhesive 50 is covered and protected by a release layer 64. This release layer 64 is removed at the time the upper closure of the bag 10 is originally closed, at which time the adhesive 50 becomes bonded to the inner surface 42 of the flap portion 30. The release layer 64 may be formed of the same material as a release liner 60 described below. In this embodiment at the time the upper closure of the bag 10 is originally closed, the resealable closure 24 has the same appearance as shown in FIG. 4.

The surface of the release liner 48 opposite that contacting the adhesive 50 is adhesively secured to a sheet member 52 by a releasable adhesive 54. In one embodiment, the releasable adhesive 54 has a peel strength of about one pound per inch or less. In another embodiment, the releasable adhesive 54 has a peel strength in the range from about 0.5 to less than one pound per inch.

In one embodiment, the sheet member 52 is a 50 pound litho pre-primed paper. In another embodiment, the sheet member 52 is a 2 mil polyester film. In another embodiment, the sheet member 52 is polyethylene terephthalate, polyethylene or polypropylene. The weight per ream of the sheet member 52 may vary from about 30 pounds to about 120 pounds. The sheet member 52 may be constructed of other materials as disclosed in more detail herein. In other embodiments, the sheet member 52 could be constructed of, e.g., a polypropylene or polystyrene film or blend thereof, and vary in thickness from about 1 to about 4 mils.

The releasable adhesive 54 is described in more detail hereinabove. In one embodiment, the releasable adhesive 54 is applied in a continuous film which covers the entire area of the sheet member 52. In one embodiment, the releasable adhesive 54 is applied in a continuous film which corresponds to the entire area of the release liner 48. In another embodiment, the releasable adhesive 54 is patterned in lines or stripes to allow easy removal of release liner 48 therefrom while having good aggressive reseal capabilities. In another embodiment, shown in FIG. 10, the releasable adhesive 54 is provided with a deadened or adhesive-free area 56 to allow easy gripping of the flap portion 30. In another embodiment, shown in FIG. 11, the releasable adhesive 54 is provided with a plurality of deadened or adhesive-free areas, to provide easier release. In other embodiments, the deadened or adhesive-free area or areas 56 could be provided at the lower corners of the resealable closure 24 or at other locations if so desired. A number of embodiments of the applied releasable adhesive 54, which form a variety of patterns of deadened or adhesive-free areas, are described below in relation to FIGS. 17A–17H. In addition, in another embodiment, one or more adhesive-free flaps extends from the resealable closure 24 to assist the user in gripping the flap portion 30 when the closure is moved from its sealed closed position to its unsealed open position.

The back surface of the sheet member 52 (the bottom surface of sheet member 52 as viewed in FIGS. 3–5, opposite to that attached to the releasable adhesive 54) has an adhesive 58 thereon which is used for attaching the resealable closure 24 to the front surface 14 of the bag 10. In one embodiment, the adhesive 58 is the same adhesive as the adhesive 50. In other embodiments, the adhesive 58 may be any of the alternative adhesives disclosed above with respect to the adhesive 50, or disclosed elsewhere herein. As shown in FIG. 3, the adhesive 58 may be adhered to and covered by a release liner 60 during fabrication, and prior to application to the bag 10, of the resealable closure 24. When the resealable closure 24 is to be secured to the bag 10, the release liner 60 is removed and discarded. The release liner 60 may be any suitable material, for example, a 40 pound bleached kraft stock material. In other embodiments, the release liner 60 may be, for example, 40 pound BG, 40 pound single-coated kraft paper, 50 pound single-coated kraft paper or 44 pound polycoated kraft paper.

The resealable closure 24 may be installed on the bag 10 during the manufacture of the bag, and usually before the bag has been filled with the particulate material for which it is to be used. In one embodiment, the flap 26 is held in place by an adhesive in conventional fashion. The upper end 20 of the bag 10, including the flap 26 and the flap portion 30, is initially sealed to the front wall 14 by a conventional adhesive, and partially by the resealable closure 24.

Figure 8:
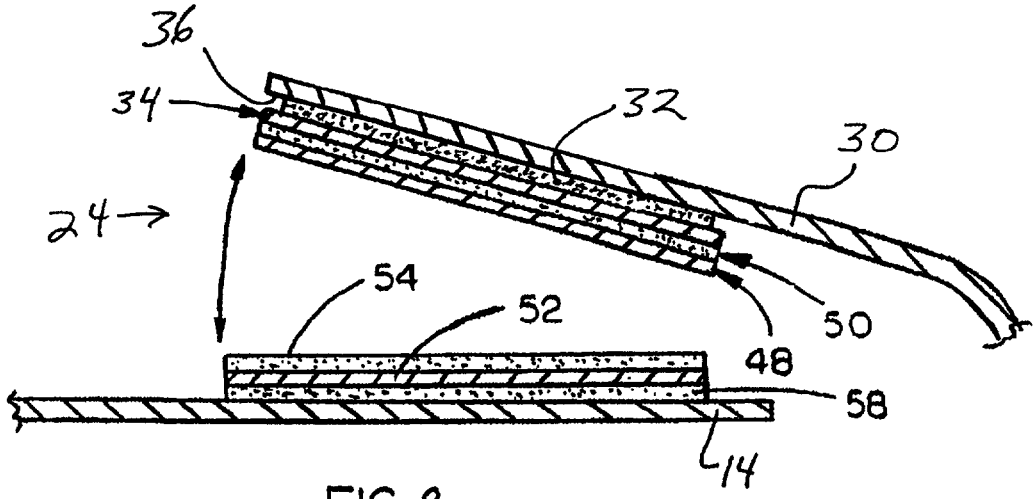
FIG. 8 is a cross-sectional view of the embodiment of the resealable closure of FIG. 6 with the resealable closure in an open position.

As shown in FIGS. 1, 2 and 13–16, when the user desires to dispense some of the contents of the bag 10, the user may grasp the resealable closure 24 at the edges thereof or, in embodiments including such, at the deadened or adhesive-free areas or the non-adhesive flap, and pulls outwardly and upwardly from the bag 10. This action causes the flap portion 30 to separate from the flap 26 at the perforated line 28, or at other locations selected by the user, to form a pour spout at the upper end of the bag 10 adjacent the side wall 16. As shown in FIGS. 5 and 8, when an upward and outward force is applied to the resealable closure 24 during the opening process, the release liner 48 separates from the releasable adhesive 54, which remains attached to the sheet member 52, which is in turn adhesively secured to the front wall 14.

The release liner 48 separates from the releasable adhesive 54 because the binding strength between the release liner 48 and the releasable adhesive 54, having a peel strength of up to about 1 pound per inch, is less than the binding strength between the adhesive 54 and the sheet member 52, and is less than the binding strength of the adhesive 58 which secures the sheet member 52 to the bag 10, each of which have a peel strength greater than one pound per inch, and in some embodiments up to at least about 4 pounds per inch. Similarly, during the opening process, the flap portion 30 does not separate from the release liner 48, since the binding adhesive strength of adhesive 50, which has a peel strength of greater than one pound per inch, and in some embodiments up to at least about 4 pounds per inch, is greater than the force required to separate the release liner 48 from the releasable adhesive 54, which has a peel strength of up to about 1 pound per inch.

In one embodiment in which the releasable adhesive 54 is applied to the front wall 14, and the release liner 48 is applied to the flap portion 30, when the resealable closure 24 has been opened to form the pour spout, the material being poured from the bag 10 will not stick or adhere to the resealable closure 24, since the only portion of the resealable closure 24 which comes into contact with the material is the release liner 48 which is not sticky or tacky. The material from the bag does not come into contact with the releasable adhesive 54, since it remains on the front wall 14 of the bag 10 below the pour opening.

The bag 10 may then be resealed by simply bringing the release liner 48 into engagement with the releasable adhesive 54, which closes the resealable closure 24 and the flap portion 30.

In another embodiment, the releasable adhesive 54 is applied to be disposed and remain on the flap portion 30 when the spout is opened, and the release liner 48 is disposed on the front wall 14 of the bag 10. This "inverted" arrangement of the layers of the resealable closure is illustrated in FIGS. 3-I*nv*, 4-Inv and 5-Inv, which correspond to FIGS. 3, 4 and 5, except that the layers are arranged in inverted order.

Figure 6:
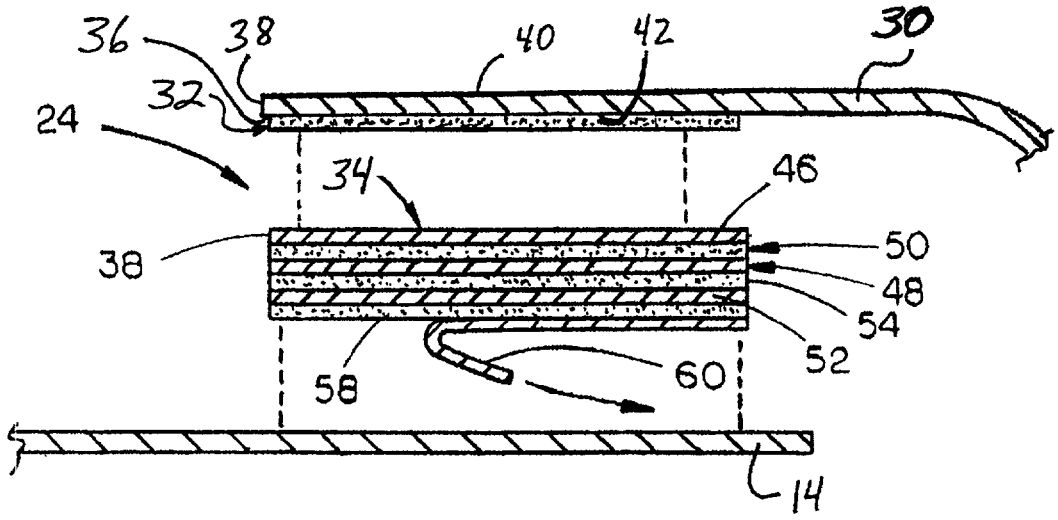
FIG. 6 is a cross-sectional view of another embodiment of the resealable closure during application of the closure to a bag, in accordance with the present invention.
Figure 7:
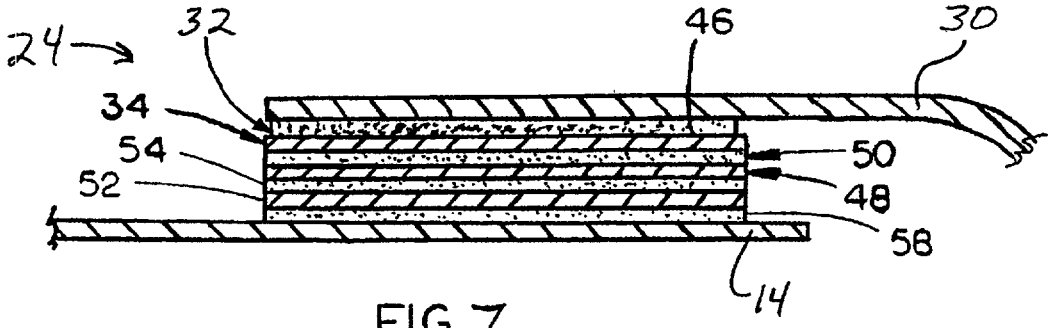
FIG. 7 is a cross-sectional view of the embodiment of the resealable closure of FIG. 6 with the resealable closure in a closed position.

A second embodiment of the resealable closure 24 is shown in FIGS. 6–8. FIG. 6 is a cross-sectional view of another embodiment of the resealable closure during application of the closure to a bag, in accordance with the present invention. FIG. 7 is a cross-sectional view of the embodiment of the resealable closure of FIG. 6 with the resealable closure in a closed position. FIG. 8 is a cross-sectional view of the embodiment of the resealable closure of FIG. 6 with the resealable closure in an open position.

As shown in FIGS. 6–8, in the second embodiment, as in the first embodiment, the flap portion 30 includes a lower end 38, a outer surface 40 and an inner surface 42. Since the flap portion 30 may be an extension of the back wall 12, the outer surface 40 may be substantially the same as the outer surface of the back wall 12, as described herein. Similarly, since the inner surface 42 may be an extension of the inner liner of the bag 10, the inner surface may be substantially the same material as the inner liner, as described herein.

In this embodiment, the flap portion 30 has an adhesive 32 adhered to the inner surface 42. This adhesive 32 corresponds to the glue line 32 shown in FIG. 2, except that in this embodiment the glue line is expanded to cover an area of the flap portion 30 substantially corresponding in size to the size of the portion of the resealable closure 24 which attaches to the front wall 14 of the bag 10. In one embodiment, the adhesive 32 is an emulsion acrylic PSA sold under the tradename S490 by the Fasson Division of the Avery Dennison Corporation. In one embodiment, the adhesive 32 is a rubber-based hot melt adhesive, such as 975-04, available from the Fasson Division of the Avery Dennison Corporation. In one embodiment, the adhesive 32 is another acrylic emulsion PSA, such as the tacky microspheres described herein, available from the Fasson Division of the Avery Dennison Corporation. In one embodiment, the adhesive 32 is an acrylic solvent-based PSA.

Figure 18:
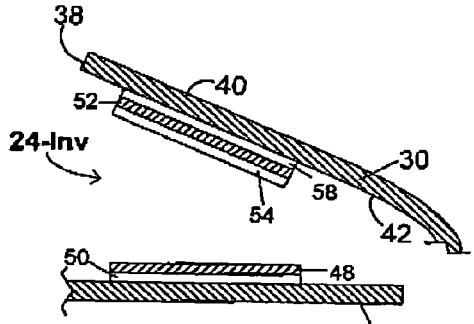
FIG. 18 is a cross-sectional view of an embodiment in which the releasable adhesive includes microspheres.
Figure 18:
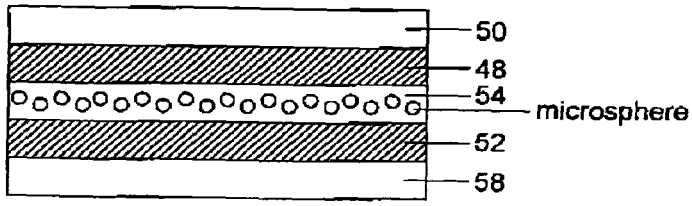

FIG. 18 is a cross-sectional view of an embodiment in which the releasable adhesive includes microspheres.

As shown in FIGS. 6–8, in this embodiment the adhesive 32 is applied to the flap portion 30 to leave a small no-adhesive area 36 of the inner surface 42, to which the adhesive 32 is not applied. The no-adhesive area 36 provides a point at which a user can grasp the resealable closure 24 to open the closure, as described below. As such, the no-adhesive area 36 may be considered as a deadened or adhesive-free area. Other embodiments of deadened or adhesive-free areas have been described above.

As shown in FIGS. 6–8, the resealable closure 24 includes a sheet member 34. In one embodiment, the sheet member 34 is 60 pound kraft paper, in another embodiment, kraft paper having a weight in the range from about 30 pounds to about 120 pounds, or in the range from about 40 pounds to about 60 pounds. In one embodiment, the sheet member 34 is a polymer film, such as polyethylene, polypropylene, PET, polystyrene, or any of those described herein.

The sheet member 34 is secured to a release liner 48 by an adhesive 50. The remainder of the description of FIGS. 6–8, beginning with the release liner 48, is substantially the same as the description of FIGS. 3–5 provided above, and will not be repeated here, except for the additional layer of the adhesive 32 and the sheet member 34. These additional layers provide added stiffness and strength to the resealable closure 24. Thus, when the resealable closure 24 is opened as described below, the additional layers, i.e., the adhesive 32 and the sheet member 34, provide additional stiffness, thereby aiding in opening of the closure, and additional strength, thereby avoiding damage to the closure 24 after repeated use. The additional layers of the adhesive 32 and the sheet member 34 may also provide added durability, convertibility and dispensability.

Figure 10:
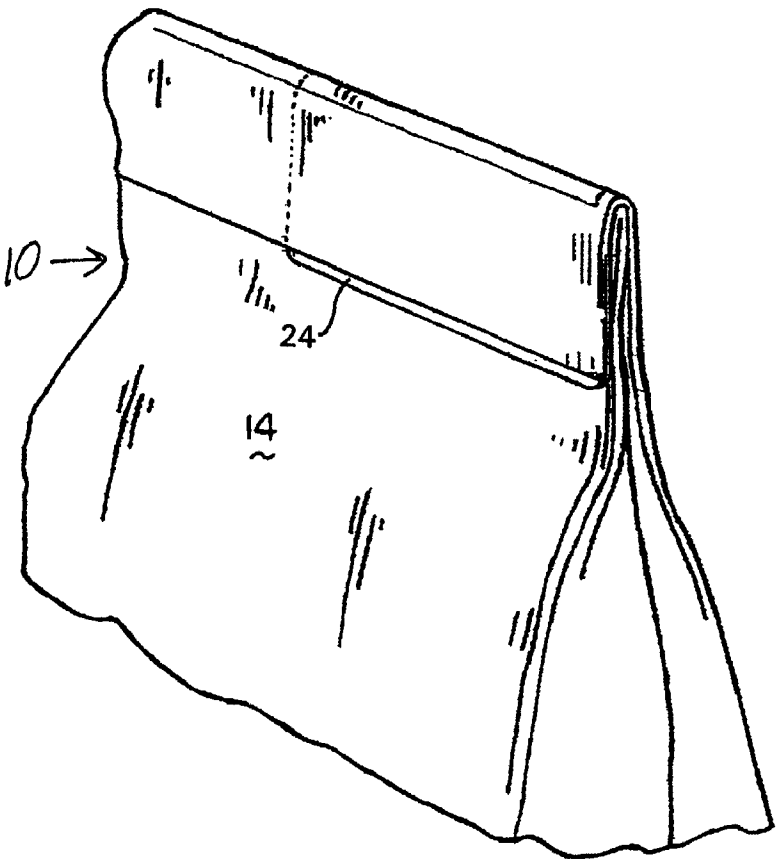
FIG. 10 is a perspective view of another embodiment of the resealable closure in closed position on a bag, in accordance with the present invention.
Figure 9:
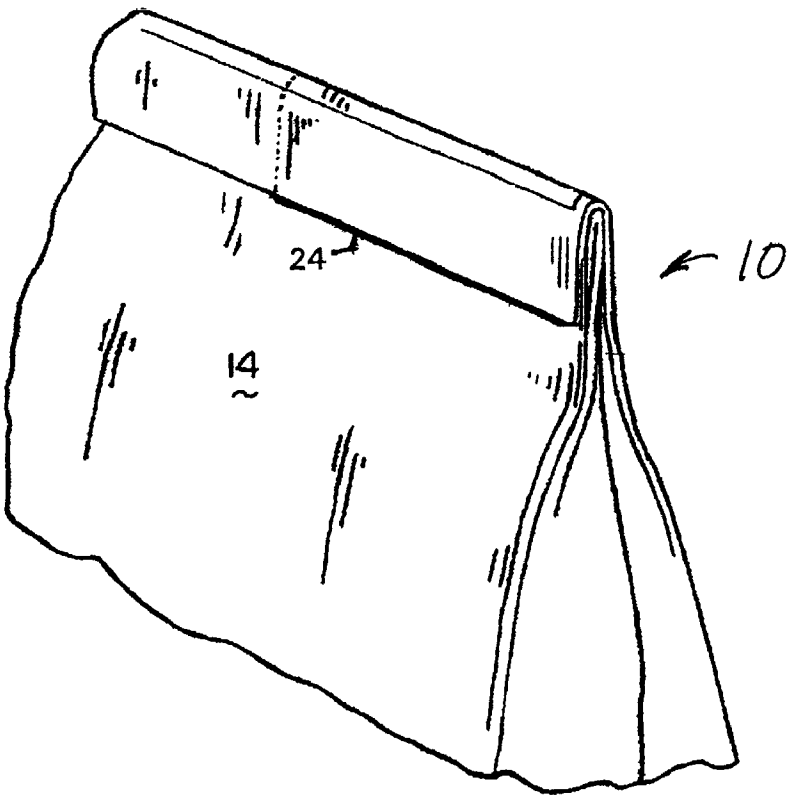
FIG. 9 is a perspective view of an embodiment of the resealable closure in closed position on a bag, in accordance with the present invention.
Figure 12:
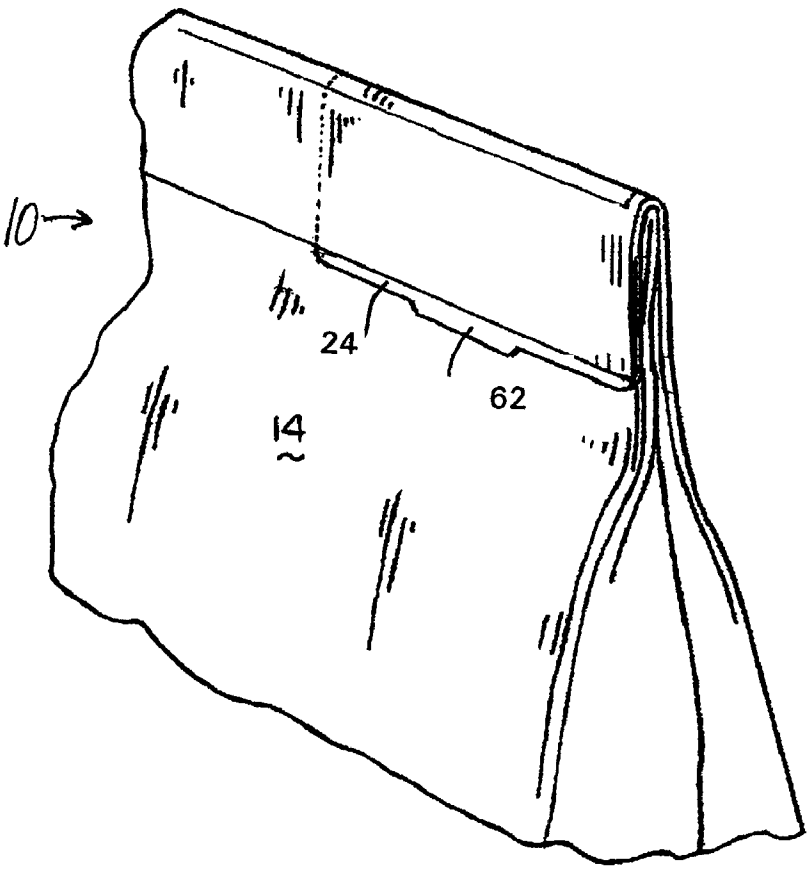
FIG. 12 is a perspective view of another embodiment of the resealable closure in closed position on a bag, in accordance with the present invention, including an opening tab.
Figure 11:
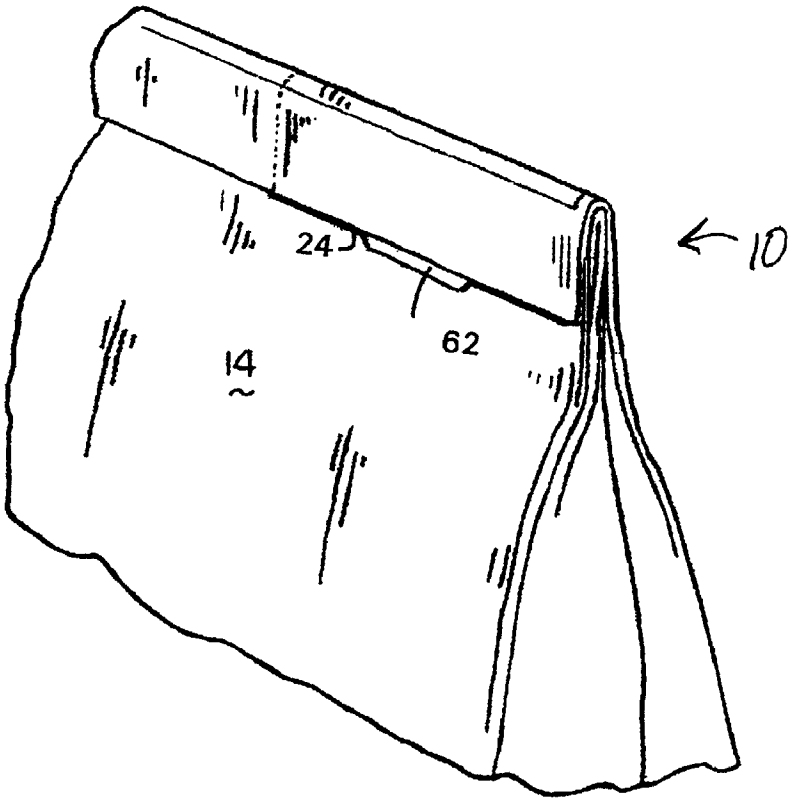
FIG. 11 is a perspective view of another embodiment of the resealable closure in closed position on a bag, in accordance with the present invention, including an opening tab.

FIGS. 9–16 illustrate several embodiments of the resealable closure 24 in use with a bag 10. FIGS. 9 and 10 are perspective views of embodiments of the resealable closure 24 in closed position on a bag 10, in accordance with the present invention. FIGS. 11 and 12 are perspective views of embodiments of the resealable closure 24 in closed position on a bag 10, in which each resealable closure 24 includes an opening tab 62. The illustrated closed position appears the same, both when the bag is new and the resealable closure 24 has never been opened, and when the bag has been opened, some of the contents dispensed, and the bag re-closed. The only difference in appearance between a new bag and a re-closed bag would be if the bag includes a sealing device which is removed, torn, ruptured or otherwise altered when the bag is initially opened.

Figure 14:
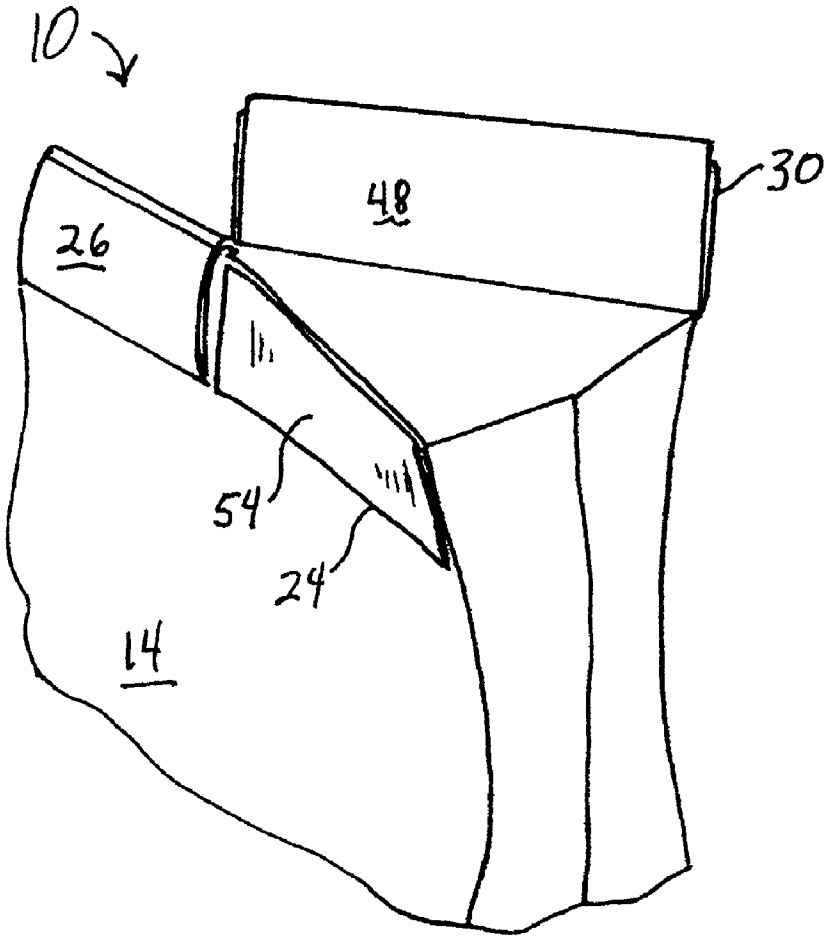
FIG. 14 is a perspective view of the embodiment of the resealable closure of FIG. 10 in opened position.
Figure 13:
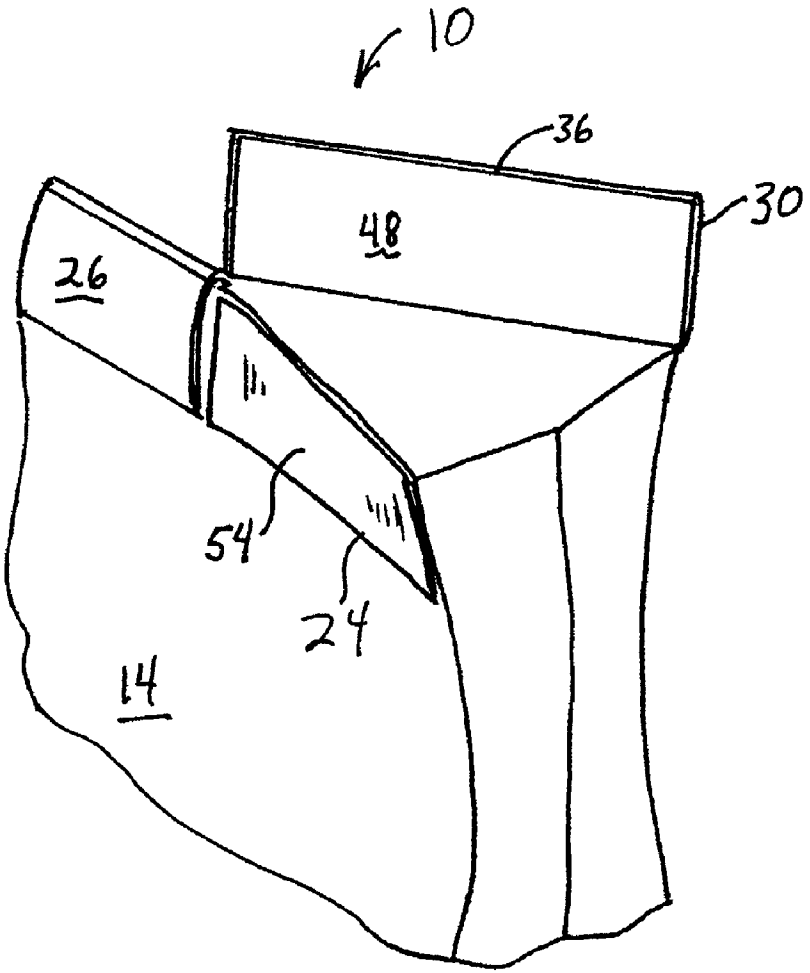
FIG. 13 is a perspective view of the embodiment of the resealable closure of FIG. 9 in opened position.
Figure 16:
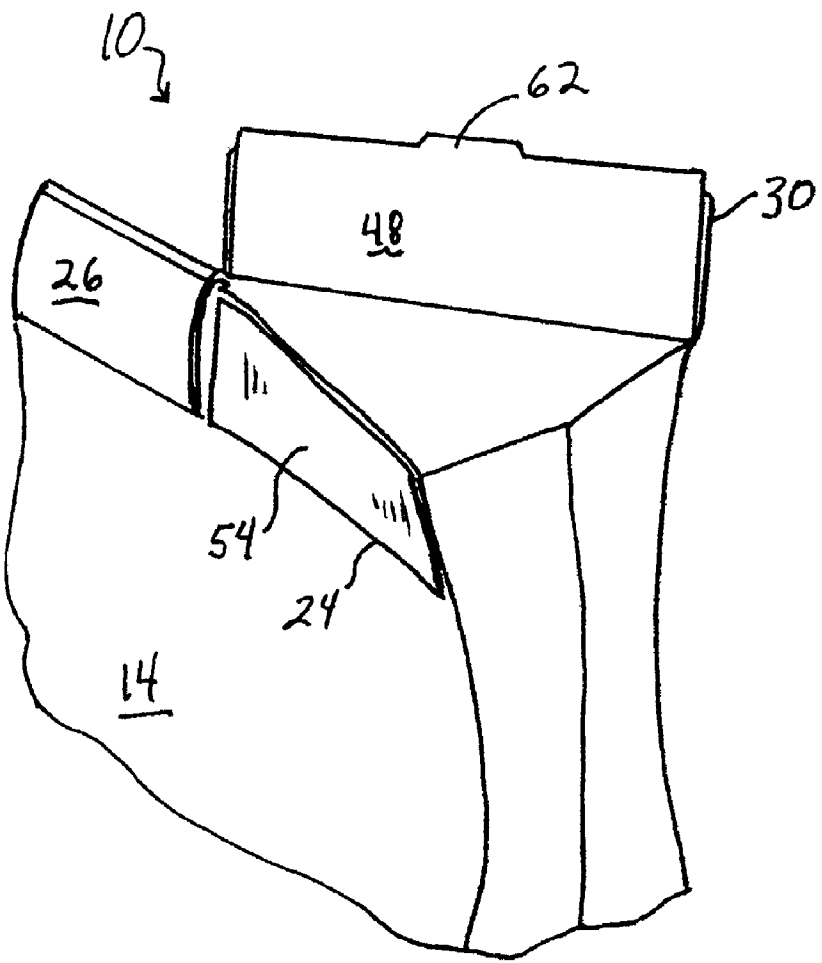
FIG. 16 is a perspective view of the embodiment of the resealable closure of FIG. 12 in opened position.
Figure 15:
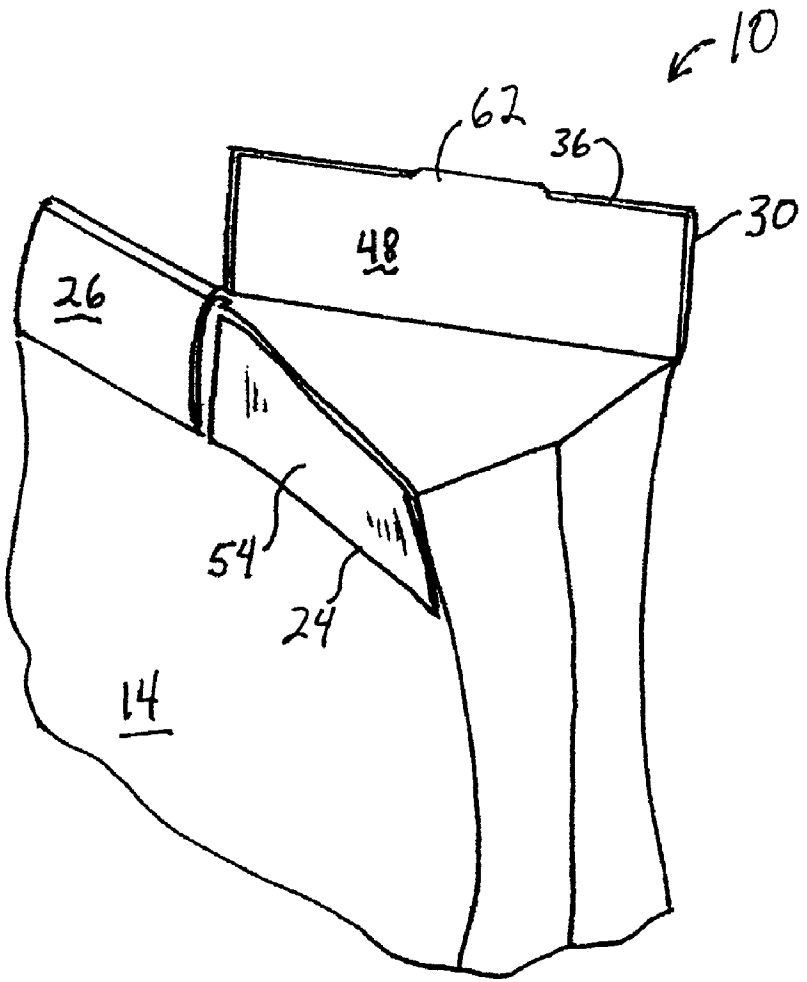
FIG. 15 is a perspective view of the embodiment of the resealable closure of FIG. 11 in opened position.

FIGS. 13 and 14 are perspective views of the embodiments of the resealable closures of FIGS. 9 and 10 in opened position. FIGS. 15 and 16 are perspective views of the embodiments of the resealable closures of FIGS. 11 and 12 in opened position, in which the resealable closure 24 includes the opening tab 62.

Products produced in accordance with the present invention may comprise a discontinuous coat of adhesive microspheres on at least a portion of at least one side of the carrier material and present in an amount to provide, in the zone bounded or defined by the adhesive, in one embodiment from about 10% to about 30%, or from about 15% to about 25%, of the adhesive present in the pattern, available for contact with a smooth substrate, such as the release surface of the present invention, relative to the amount of adhesive which would have been present if the adhesive were applied as a continuous film. To achieve this level for effective contact, from about 30% to about 75% of the zone which would have been occupied by a continuous film, is covered by pressure-sensitive microspheres. The segments have an average height of at least from about 15 microns, or at least about 20 microns, to account for the roughness of the face material and the surface to which the product is to be applied.

Figure 17A:
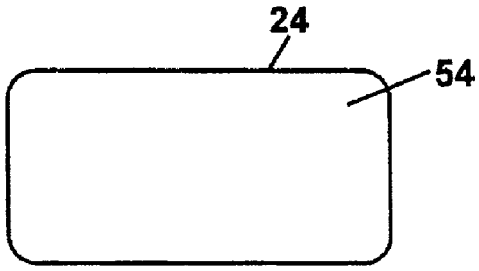
FIGS. 17A–17H are plan views of the resealable closure of the present invention, illustrating a number of embodiments of applications of the releasable adhesive, including deadened or adhesive-free areas.

FIGS. 17A–17H are plan views of the resealable closure 24 of the present invention, schematically illustrating a number of embodiments of applications of the releasable adhesive, including deadened or adhesive-free areas. FIG. 17A schematically illustrates an embodiment of the resealable closure 24 in which the releasable adhesive 54 is applied to the sheet member 52 in a continuous layer, completely covering the surface of the sheet member 52 with the releasable adhesive 54. In this embodiment, there are no deadened or adhesive-free areas, and there are substantially no non-adhesive areas on the sheet member 52.

Figure 17B:
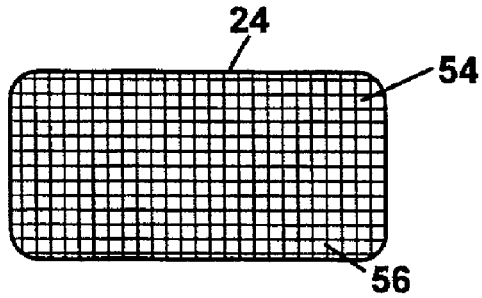
Figure 17C:
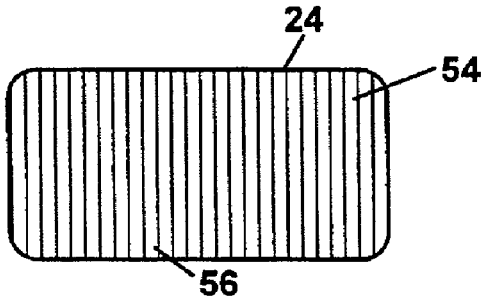
Figure 17D:
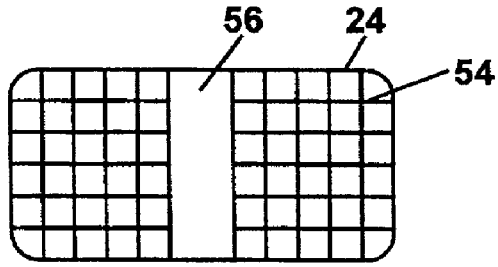
Figure 17E:
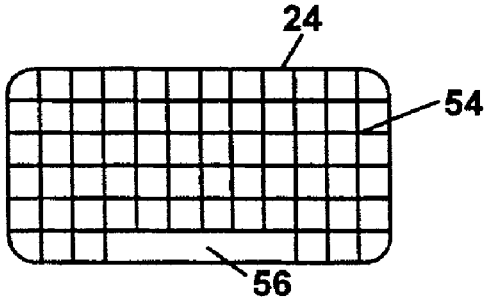
Figure 17F:
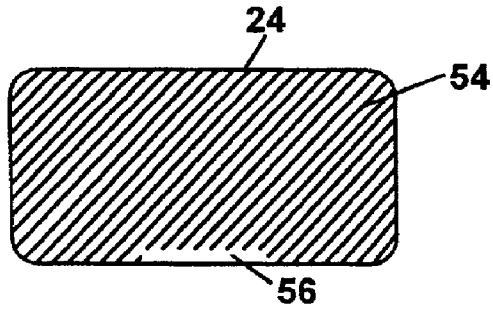
Figure 17G:
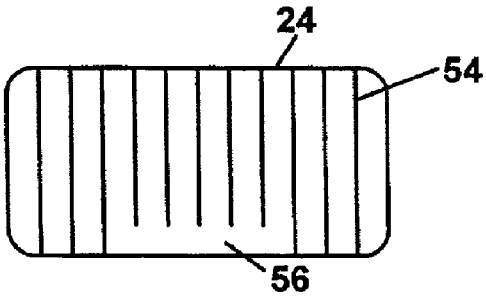
Figure 17H:
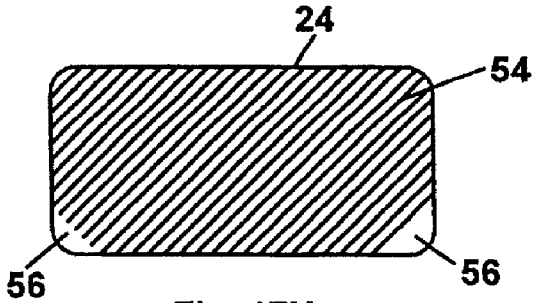

FIGS. 17B and 17C schematically illustrate embodiments of the resealable closure 24 in which the releasable adhesive 54 is applied to the sheet member 52 in patterns of cris-cross stripes or lines (FIG. 17B) and of simple stripes or lines (FIG. 17C). In these embodiments, the interstitial areas of FIG. 17B and the interlinear areas of FIG. 17C are deadened or adhesive-free areas 56.

FIGS. 17D through 17H schematically illustrate embodiments of the resealable closure 24 in which the releasable adhesive 54 is applied to the sheet member 52 in various patterns of criss-cross stripes or lines (FIGS. 17D and 17E) and of orthogonal or diagonal stripes or lines,(FIGS. 17F–17H), and which further include separate, deadened or adhesive-free areas 56, in addition to the interstitial and the interlinear deadened or adhesive-free areas similar to those of FIGS. 17B and 17C. The deadened or adhesive-free areas 56 in FIGS. 17D–17H provide areas which the user may grasp when opening the resealable closure 24.

In alternate embodiments, the foregoing descriptions of the strips or lines of the releasable adhesive 54 and the adhesive-free areas 56 may be reversed, except as to the deadened or adhesive-free areas provided for the user to grasp. Thus, in these alternate embodiments the lines in the figures may represent non-adhesive lines or strips, and the interstitial areas may represent islands of the releasable adhesive 54. In these alternate embodiments corresponding to FIGS. 17D to 17H, the deadened or non-adhesive areas at the edges of the releasable closure 24, for the user's grasp, may be retained.

The following schematic figure provides a cross-sectional view of one embodiment of the present invention, in which the resealable closure 24 is in an open position.

| | |
|---|---|
| 60 lb. semi gloss elite paper | first sheet member |
| S490 adhesive | second adhesive |
| 2.6 mil BOPP[1] | release surface |
| UR-1 or UR-2 | releasable adhesive |
| 50 lb. paper | second sheet member |
| S490 adhesive | third adhesive |
| 40 lb. throw away liner | second release surface |

[1]Biaxially oriented polypropylene

As shown in the above figure, in this embodiment, the resealable closure 24 has not yet been applied to the front surface of the bag 10, but instead includes a 40 pound throw away liner, which corresponds to the release liner 60 in FIGS. 3 and 6.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A resealable closure on a container comprising:

a container having a main body portion and an integral extended body portion foldable over a part of the main body portion; and a releasable closure comprising:

a first adhesive layer having an upper and lower surface;

a release liner having an upper and lower surface, wherein the upper surface of the release liner is directly attached to the lower surface of the first adhesive layer;

a releasable adhesive layer having an upper and lower surface, wherein the upper surface of the releasable adhesive layer is directly and releasably attached to the lower surface of the release liner and wherein the releasable adhesive is a pressure-sensitive adhesive having a peel strength in the range from about 0.4 to about 0.9 pounds per inch;

a sheet member having an upper and lower surface, wherein the upper surface of the sheet member is attached to the lower surface of the releasable adhesive; and a second adhesive layer having an upper and lower surface, wherein the upper surface of the second adhesive layer is attached to the lower surface of the sheet member, wherein (a) the lower surface of the second adhesive layer is adhered to the main body portion and the upper surface of the first adhesive layer is adhered to the extended body portion, or (b) the lower surface of the second adhesive layer is adhered to the extended body portion and the upper surface of the first adhesive layer is adhered to the main body portion.

2. A resealable closure as in claim 1, wherein the extended body portion is foldable over a part of the main body portion to bring the release liner and the releasable adhesive into sealing contact.

3. A resealable closure as in claim 1, wherein the container is free of a reclosure strip.

4. A resealable closure as in claim 1, wherein the releasable adhesive comprises an acrylic pressure sensitive adhesive.

5. A resealable closure as in claim 1, wherein the releasable adhesive comprises adhesive microspheres.

6. A resealable closure as in claim 1, wherein a surface upon which the releasable adhesive is applied includes at least one non-adhesive area.

7. A resealable closure as in claim 1, wherein the releasable adhesive is applied in a continuous film.

8. A resealable closure as in claim 1, wherein the release liner comprises paper with a releasable coating on the paper.

9. A resealable closure as in claim 1, wherein the release liner comprises a polymer film.

10. A resealable closure as in claim 9, wherein the polymer film is polypropylene.

11. A resealable closure as in claim 9, wherein the polymer film is biaxially oriented polypropylene.

12. A resealable closure as in claim 1, wherein the releasable adhesive adheres to the main body portion or to the extended body portion with a peel strength greater than one pound per inch.

13. A resealable closure as in claim 1, wherein the extended body portion comprises a fold-over flap.

14. A resealable closure as in claim 13, wherein the main body portion comprises a front panel and a back panel, and the extended body portion extends from the back panel.

15. A resealable closure as in claim 1, wherein the releasable adhesive is adhered to the main body portion.

16. A resealable closure on a container comprising:

a container having a main body portion and an integral extended body portion foldable over a part of the main body portion; and a releasable closure comprising:

a first adhesive layer having an upper and lower surface;

a release liner having an upper and lower surface, wherein the upper surface of the release liner is directly attached to the lower surface of the first adhesive layer;

a releasable adhesive layer having an upper and lower surface, wherein the upper surface of the releasable adhesive layer is directly and releasably attached to the lower surface of the release liner and wherein the releasable adhesive is a pressure-sensitive adhesive having a peel strength in the range from about 0.4 to about 0.9 pounds per inch;

a sheet member having an upper and lower surface, wherein the upper surface of the sheet member is attached to the lower surface of the releasable adhesive; and a second adhesive layer having an upper and lower surface, wherein the upper surface of the second adhesive layer is attached to the lower surface of the sheet member, wherein the releasable closure further comprises a second sheet member having an upper and lower surface, wherein the lower surface of the second sheet member is attached to the upper surface of the first adhesive layer, and a third adhesive layer having an upper and lower surface, wherein the lower surface of the third adhesive layer is attached to the upper surface of the second sheet member.

17. A resealable closure on a container comprising:

a container integrally formed with a body portion and a flap portion; and a releasable closure comprising:

a first adhesive layer having an upper and lower surface;

a release liner having an upper and lower surface, wherein the upper surface of the release liner is directly attached to the lower surface of the first adhesive layer;

a releasable adhesive layer having an upper and lower surface, wherein the upper surface of the releasable adhesive layer is directly and releasably attached to the lower surface of the release liner;

a sheet member having an upper and lower surface, wherein the upper surface of the sheet member is attached to the lower surface of the releasable adhesive; and a second adhesive layer having an upper and lower surface, wherein the upper surface of the second adhesive layer is attached to the lower surface of the sheet member, wherein the releasable adhesive includes an acrylic PSA and has a peel strength up to about one pound per inch, wherein the release liner is a polymer film, and wherein one of the release liner and the releasable adhesive is adhered to the body portion and another of the release liner and the releasable adhesive is adhered to the flap portion.

18. A resealable closure as in claim 17, wherein the flap portion is foldable over a portion of the body portion to bring the release liner and the releasable adhesive into sealing contact.

19. A resealable closure as in claim 17, wherein a surface upon which the releasable adhesive is adhered includes at least one non-adhesive area.

20. A resealable closure as in claim 17, wherein the releasable adhesive forms a continuous film.

21. A resealable closure as in claim 17, wherein the releasable adhesive is an emulsion acrylic tacky microsphere adhesive.

22. A resealable closure as in claim 17, wherein the releasable adhesive has a peel strength in the range from about 0.4 to about 1 pound per inch.

23. A resealable closure as in claim 17, wherein the releasable adhesive adheres to the body portion or to the flap portion with a peel strength greater than one pound per inch.

24. A resealable closure on a container comprising:

a container having a main body portion and an integral extended body portion foldable over a part of the main body portion; and a releasable closure comprising:

a first adhesive layer having an upper and lower surface;

a release liner having an upper and lower surface, wherein the upper surface of the release liner is directly attached to the lower surface of the first adhesive layer;

a releasable adhesive layer having an upper and lower surface, wherein the upper surface of the releasable adhesive layer is directly and releasably attached to the lower surface of the release liner;

a sheet member having an upper and lower surface, wherein the upper surface of the sheet member is attached to the lower surface of the releasable adhesive; and a second adhesive layer having an upper and lower surface, wherein the upper surface of the second adhesive layer is attached to the lower surface of the sheet member, wherein the releasable closure further comprises a second sheet member having an upper and lower surface, wherein the lower surface of the second sheet member is attached to the upper surface of the first adhesive layer, and a third adhesive layer having an upper and lower surface, wherein the lower surface of the third adhesive layer is attached to the upper surface of the second sheet member, wherein the releasable adhesive includes an acrylic PSA and has a peel strength up to about one pound per inch, wherein the release liner is a polymer film, and wherein one of the release liner and the releasable adhesive is adhered to the body portion and another of the release liner and the releasable adhesive is adhered to the flap portion.

25. A resealable container, comprising integral front wall and back wall members, the back wall member having a flap member extending beyond an end of the front wall member;

a releasable closure comprising:

a first adhesive layer having an upper and lower surface;

a release liner having an upper and lower surface, wherein the upper surface of the release liner is directly attached to the lower surface of the first adhesive layer;

a releasable adhesive layer having an upper and lower surface, wherein the upper surface of the releasable adhesive layer is directly and releasably attached to the lower surface of the release liner and wherein the releasable adhesive is a pressure-sensitive adhesive;

a sheet member having an upper and lower surface, wherein the upper surface of the sheet member is attached to the lower surface of the releasable adhesive; and a second adhesive layer having an upper and lower surface, wherein the upper surface of the second adhesive layer is attached to the lower surface of the sheet member, wherein the releasable closure is formed on the front wall member and the flap member, and the releasable adhesive has a peel strength up to about one pound per inch.

26. A resealable container as in claim 25, wherein the release liner is disposed on the flap portion such that when the flap is folded over, the release liner mates with the releasable adhesive.

27. A resealable container as in claim 25, wherein the back wall member has a first width and the flap member has a second width substantially the same as the first width.

28. A resealable container as in claim 25, wherein the resealable container further comprises at least one side wall member.

29. A resealable container comprising:

a plurality of walls defining an interior space; and a releasable closure comprising:

a first adhesive layer having an upper and lower surface;

a release liner having an upper and lower surface, wherein the upper surface of the release liner is directly attached to the lower surface of the first adhesive layer;

a releasable adhesive layer having an upper and lower surface, wherein the upper surface of the releasable adhesive layer is directly and releasably attached to the lower surface of the release liner;

a sheet member having an upper and lower surface, wherein the upper surface of the sheet member is attached to the lower surface of the releasable adhesive; and a second adhesive layer having an upper and lower surface, wherein the upper surface of the second adhesive layer is attached to the lower surface of the sheet member, wherein the releasable adhesive is a pressure-sensitive adhesive and has a peel strength up to about one pound per inch, and wherein one of the upper surface of the first adhesive layer or the lower surface of the second adhesive layer is adhered to a first of the plurality of walls, and an other one of the upper surface of the first adhesive layer or the lower surface of the second adhesive layer is adhered to a second of the plurality of walls, and wherein one of the first and the second of the plurality of walls extends beyond the other to form an integral flap, and the integral flap is foldable to bring the release liner into releasably sealing contact with the releasable adhesive.

30. A resealable closure on a container, the container having a first body portion and a second body portion, the resealable closure comprising:

a first adhesive layer having an upper and lower surface;

a release liner having an upper and lower surface, wherein the upper surface of the release liner is directly attached to the lower surface of the first adhesive layer;

a releasable adhesive layer having an upper and lower surface, wherein the upper surface of the releasable adhesive layer is directly and releasably attached to the lower surface of the release liner and wherein the releasable adhesive is a pressure-sensitive adhesive having a peel strength in the range from about 0.4 to about 0.9 pounds per inch;

a sheet member having an upper and lower surface, wherein the upper surface of the sheet member is attached to the lower surface of the releasable adhesive; and a second adhesive layer having an upper and lower surface, wherein the upper surface of the second adhesive layer is attached to the lower surface of the sheet member, wherein the first body portion is a main body portion and the second body portion is an extended body portion foldable over a part of the main body portion.

31. A resealable closure on a container, comprising:

a first adhesive having an upper and lower surface;

a first release liner having an upper surface directly attached to the lower surface of the first adhesive;

a releasable adhesive having an upper surface directly and releasably attached to the lower surface of the first release liner and having a peel strength of up to about 1 pound per inch and wherein the releasable adhesive is a pressure-sensitive adhesive having a peel strength in the range from about 0.4 to about 0.9 pounds per inch;

a sheet member having an upper surface attached to the lower surface of the releasable adhesive; and a second adhesive having an upper and lower surface, wherein the upper surface is applied to the lower surface of the sheet member.

32. The resealable closure of claim 31, further comprising a second release liner attached to the upper surface of the first adhesive layer.

33. The resealable closure of claim 31, further comprising a third release liner attached to the lower surface of the second adhesive layer.

* * * * *